US011624542B2

(12) United States Patent
Sung

(10) Patent No.: US 11,624,542 B2
(45) Date of Patent: Apr. 11, 2023

(54) REFRIGERATOR

(71) Applicant: LG Electronics Inc., Seoul (KR)

(72) Inventor: Chiun Sung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 142 days.

(21) Appl. No.: 17/162,449

(22) Filed: Jan. 29, 2021

(65) Prior Publication Data

US 2021/0148625 A1 May 20, 2021

Related U.S. Application Data

(62) Division of application No. 15/889,993, filed on Feb. 6, 2018, now Pat. No. 10,935,301.

(30) Foreign Application Priority Data

Apr. 11, 2017 (KR) ..... 10-2017-0046453

(51) Int. Cl.
*F25D 13/04* (2006.01)
*F25D 11/02* (2006.01)
(Continued)

(52) U.S. Cl.
CPC ..... *F25D 11/022* (2013.01); *F25B 21/02* (2013.01); *F25D 11/025* (2013.01);
(Continued)

(58) Field of Classification Search
CPC ..... F25D 11/022; F25D 11/027; F25D 13/04; F25D 21/006; F25D 21/008; F25D 2201/12; F25B 21/02
See application file for complete search history.

(56) References Cited

U.S. PATENT DOCUMENTS

2012/0073309 A1 3/2012 Hung et al.
2012/0304667 A1 12/2012 Shin et al.
(Continued)

FOREIGN PATENT DOCUMENTS

EP 2746701 6/2014
KR 1020100056811 5/2010
(Continued)

OTHER PUBLICATIONS

Hong, A refrigerator comprising a sub-stroage chamber and a cooling device, 2013, Full Document (Year: 2013).*
(Continued)

*Primary Examiner* — Nael N Babaa
(74) *Attorney, Agent, or Firm* — Fish & Richardson P.C.

(57) ABSTRACT

A refrigerator includes a main body defining a storage space, a cryogenic freezing compartment having an insulation space that is independent with respect to the storage space, an evaporator disposed inside the storage space to cool the storage space, and a thermoelectric module assembly disposed at one side of the cryogenic freezing compartment so that the cryogenic freezing compartment is cooled to a temperature less than that of the storage space. The thermoelectric module assembly includes a thermoelectric module, a cold sink coming into contact with a heat absorption surface of the thermoelectric module and disposed in the cryogenic freezing compartment, and a heat sink coming into contact with a heat generation surface of the thermoelectric module. The heat sink is cooled by introducing a refrigerant supplied to the evaporator.

20 Claims, 27 Drawing Sheets

(51) Int. Cl.

| | |
|---|---|
| ***F25D 21/00*** | (2006.01) |
| ***F25B 21/02*** | (2006.01) |
| *F25D 25/02* | (2006.01) |

(52) U.S. Cl.

CPC ..... *F25D 11/027* (2013.01); *F25D 13/04* (2013.01); *F25D 21/006* (2013.01); *F25D 21/008* (2013.01); *F25B 2321/023* (2013.01); *F25D 25/025* (2013.01); *F25D 2201/12* (2013.01); *F25D 2317/061* (2013.01)

(56) References Cited

U.S. PATENT DOCUMENTS

| | | | | |
|---|---|---|---|---|
| 2013/0276465 | A1 | 10/2013 | Shin et al. | |
| 2015/0308749 | A1* | 10/2015 | Huang ..... | F28D 15/0275 165/104.21 |
| 2016/0327321 | A1 | 11/2016 | Sugimoto et al. | |

FOREIGN PATENT DOCUMENTS

| | | | | |
|---|---|---|---|---|
| KR | 101220488 | | 1/2013 | |
| KR | 2013004847 A | * | 1/2013 | ..... H04W 72/042 |
| KR | 1020130048474 | | 5/2013 | |
| KR | 101619720 | | 5/2016 | |
| KR | 20160087940 | | 7/2016 | |
| KR | 1020160097648 | | 8/2016 | |

OTHER PUBLICATIONS

KR Office Action in Korean Appln. No. 10-2017-0046453, dated Feb. 1, 2021, 10 pages (with English translation).

Chun, "Radiator for peltier module working refrigerator," Nov. 19, 2015, Full Document (Year: 2015).

Kwun, Welded construction of the inlet and outlet pipes of the heat exchanger, Jan. 14, 2015, Full Document (Year: 2015).

Singh, Refrigerator with no-frost freezer, Dec. 20, 2012, Full Document (Year: 2012).

KR Office Action in Korean Appln. No. 10-2017-0046453, dated May 20, 2021, 10 pages (with English translation).

* cited by examiner

REFRIGERATOR

CROSS-REFERENCE TO RELATED APPLICATIONS

The present application is a divisional of U.S. application Ser. No. 15/889,993, filed on Feb. 6, 2018, which claims priority under 35 U.S.C. 119 and 35 U.S.C. 365 to Korean Patent Application No. 10-2017-0046453, filed on Apr. 11, 2017. The disclosures of the prior applications are incorporated by reference in their entirety.

BACKGROUND

The present disclosure relates to a refrigerator including cryogenic freezing compartment.

Generally, refrigerators are household appliances that store foods at a low temperature. An inner space of such as a refrigerator may be divided into a refrigerating compartment and a freezing compartment according to temperatures for foods stored in the refrigerator. The refrigerating compartment generally maintains a temperature of about 3 degrees Celsius to about 4 degrees Celsius, and the freezing compartment generally maintains a temperature of about −20 degrees Celsius.

The freezing compartment having a temperature of about −20 degrees Celsius is a space in which foods are kept in a frozen state and is often used by consumers to store the foods for a long time. However, in the existing freezing compartment, which maintains a temperature of about −20 degrees Celsius, when water within cells is frozen while freezing meat or seafood, a phenomenon in which water is exuded out of the cells may occur, and thus, the cells are destroyed. As a result, when cooking the foods after thawing, their original taste may be lost, or the texture may change.

On the other hand, when meat or seafood is frozen, the temperature rapidly passes through the freezing point temperature zone in which intracellular ice is formed to minimize the cell destruction. Thus, even after thawing, meatiness and texture may be renewed or reproduced freshly to make it possible to enjoy delicious dishes.

As the case stands, fancy restaurants use a cryogenic freezer that is capable of rapidly freezing meat, fish, and seafood. However, unlike restaurants that need to preserve large quantities of foods, since it is not always necessary to use the cryogenic freezer in ordinary homes, it is not easy to separately purchase the cryogenic freezer that is used in restaurants.

However, as the quality of life has improved, consumers' desire to eat more delicious foods has become stronger to lead to an increase in consumers who want to use the cryogenic freezer.

In order to meet the needs of such consumers, there has been developed a household refrigerator in which a cryogenic freezing compartment is installed in a portion of the freezing compartment. It is preferable that the cryogenic freezing compartment satisfies a temperature of about −50 degrees Celsius, such an extremely low temperature is a temperature that is not attained only by a refrigeration cycle using a general refrigerant.

Accordingly, there has been developed a household refrigerator in which a cryogenic freezing compartment is separately provided in the freezing compartment in a manner in which cooling is performed by using a refrigeration cycle up to a temperature of −20 degrees Celsius and by using a thermoelectric module (TEM) in case of cryogenic refrigeration.

However, since a temperature difference between the freezing compartment of about −20 degree Celsius and a cryogenic freezing compartment of about −50 degree Celsius is very large, it is not easy to realize a temperature of about −50 degrees Celsius by applying a structure for insulation, defrosting, cold air supply, and the like, which was applied to the design of the existing freezing compartment, to the cryogenic freezing compartment as it is.

Also, when a cryogenic freezing compartment, which occupies a space of the freezing compartment itself, is provided, since reduction in volume capacity of the freezing compartment has to be minimized, it is necessary to minimize a space occupied by the structure for cooling and circulating cold air in the cryogenic freezing compartment.

Particularly, when the cryogenic temperature is implemented using the TEM, heat exchange has to be smoothly performed both at a heat absorption side and a heat generation side of the TEM, cold air cooled by the heat exchange at the heat absorption side has to smoothly circulate, and heat exchange loss and flow loss should not occur while having a simple structure as much as possible.

Furthermore, due to the volume occupied by the TEM and related components, which are installed to achieve the cryogenic temperature, there is a possibility that a flow rate or pressure distribution in the existing grill fan assembly structure changes, and thus, the freezing in the freezing compartment is not smoothly performed.

SUMMARY

Embodiments provide a refrigerator in which an independent cryogenic freezing compartment is provided in a storage space, and the inside of the cryogenic freezing compartment is in an extremely low temperature state by a thermoelectric module.

Embodiments also provide a refrigerator in which a cryogenic freezing compartment having an extremely low temperature is realized so that a low-temperature refrigerant in a refrigeration cycle is cooled via a heat sink for cooling a heat generation part of a thermoelectric module.

Embodiments also provide a refrigerator that is improved in cooling performance of a heat generation part of a thermoelectric module.

In one embodiment, a refrigerator includes: a main body defining a storage space; a cryogenic freezing compartment having an insulation space that is independent with respect to the storage space; an evaporator disposed inside the storage space to cool the storage space; and a thermoelectric module assembly disposed at one side of the cryogenic freezing compartment so that the cryogenic freezing compartment is cooled to a temperature less than that of the storage space, wherein the thermoelectric module assembly includes: a thermoelectric module; a cold sink coming into contact with a heat absorption surface of the thermoelectric module and disposed in the cryogenic freezing compartment; and a heat sink coming into contact with a heat generation surface of the thermoelectric module, wherein the heat sink is cooled by introducing a refrigerant supplied to the evaporator.

The heat sink may be provided in a refrigerant flow path connecting an expansion device and the evaporator, which constitute a refrigeration cycle, to each other.

The heat sink may include: a refrigerant inflow tube connected to the heat sink to allow the refrigerant to be introduced therethrough; and a refrigerant outflow tube connected to the heat sink to allow the refrigerant to be discharged therethrough.

An inflow hole and an outflow hole, into which the refrigerant inflow tube and the refrigerant outflow tube are inserted, may be defined in the heat sink, and a seating part through which the refrigerant inflow tube and the refrigerant outflow tube pass and on which a welding ring for bulging processing is seated may be disposed to be stepped on each of the inflow hole and the outflow hole.

The heat sink may include: a sink body including an accommodation part providing a space through which the refrigerant flows; a plate covering an opened surface of the sink body and coming into contact with the heat generation surface; and a heat exchange fin disposed inside the accommodation part to guide a flow of the refrigerant.

The sink body may include the accommodation part that passes through the sink body, and the plate may include: a front plate covering an opened front surface of the accommodation part and coming into contact with the heat generation surface; and a rear plate covering an opened rear surface of the accommodation part.

The sink body may include the accommodation part that is recessed forward, and the plate may cover an opened front surface of the accommodation part.

A restriction piece that is bent to the sink body may be disposed on an outer end of the plate, and a restriction groove into which the restriction piece is inserted to couple the plate to the sink body may be defined in a circumference of the sink body.

The accommodation part may include a barrier that partitions the inside of the accommodation part into a first space into which the refrigerant is introduced and a second space from which the refrigerant is discharged, and the heat exchange fin may be provided in each of the first space and the second space.

The accommodation part may include a fin fixing part for fixing the heat exchange fin so that the heat exchange fin is fixed to be spaced apart from an inner surface of the accommodation part.

In the heat exchange fin, a plate-shaped material may be continuously bent to provide a passage for guiding a flow direction of the refrigerant.

The heat exchange fin may include: a plurality of contact parts coming into contact with the plate and heat-exchanged with a surface of the plate; and a fin connection part bent from an end of each of the plurality of contact parts to connect the contact parts to each other, wherein the contact parts and the fin connection part may be continuously disposed in a width direction of the heat exchange fin.

The heat exchange may include: a first passage extending in a longitudinal direction of the heat exchange fin to provide a passage through which the refrigerant flows; and a second passage of which at least a portion overlaps the first passage and which is disposed to cross the first passage and thereby to provide a passage in which the refrigerant is branched to flow, and the first passage and the second passage may be continuously disposed in the longitudinal direction of the heat exchange fin.

The first passage and the second passage may be alternately provided in plurality, and the plurality of first and second passages may be alternately disposed and have lengths different from each other.

The cryogenic freezing compartment may be disposed inside the storage space.

A grill fan assembly disposed to a front side of the evaporator to cover the evaporator may be disposed in the storage space, and the thermoelectric module assembly may be mounted on the grill fan assembly, wherein the cold sink may be disposed in a region of the cryogenic freezing compartment, and the heat sink may be disposed in a region in which the evaporator is disposed.

An insulation material accommodating the thermoelectric module may be disposed between the cold sink and the heat sink, and the insulation material may be disposed on a boundary with the grill fan assembly.

The refrigerator may further include a module housing accommodating the insulation material, the thermoelectric module, and the heat sink, wherein the module housing may be fixedly mounted on the grill fan in a state of being spaced apart from a rear wall of a space in which the evaporator is accommodated.

The heat sink may be disposed in a space between an inner case defining the storage space and a grill fan assembly covering the evaporator.

The storage space may include a freezing compartment.

The details of one or more embodiments are set forth in the accompanying drawings and the description below. Other features will be apparent from the description and drawings, and from the claims.

DETAILED DESCRIPTION OF THE EMBODIMENTS

Hereinafter, preferred embodiments will be described in more detail with reference to the accompanying drawings.

The present invention may, however, be embodied in different forms and should not be construed as limited to the embodiments set forth herein. Rather, these embodiments are provided so that the present invention will be thorough and complete, and will fully convey the scope of the present invention to those skilled in the art.

In this specification, the term "cryogenic temperature" means a temperature that is lower than about 20 degrees Celsius, which is a typical freezing storage temperature of the freezing compartment, and the temperature range is not limited numerically. Also, even in the cryogenic freezing compartment, the storage temperature may be below about 20 degrees Celsius or more.

Figure 1:
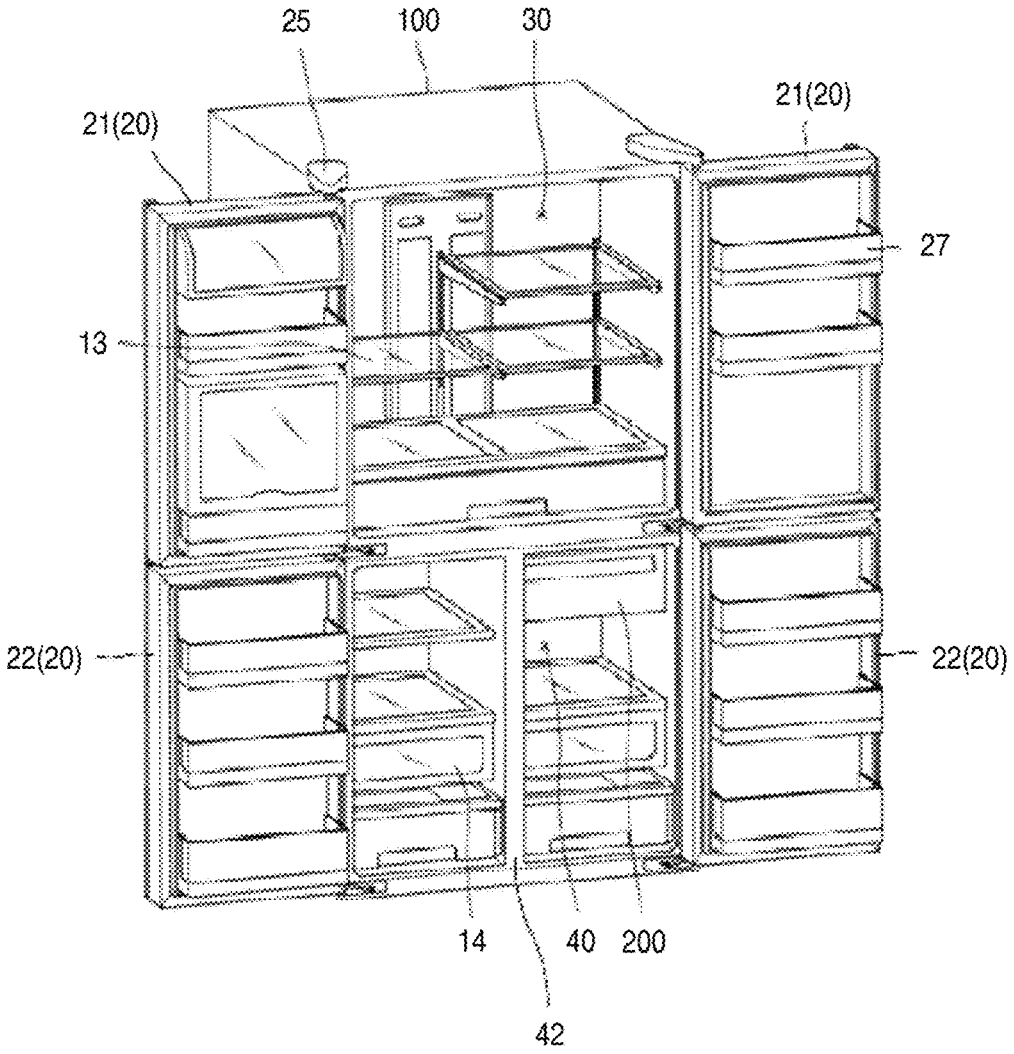
FIG. 1 is a perspective view of a refrigerator with a door opened according to an embodiment.
Figure 2:
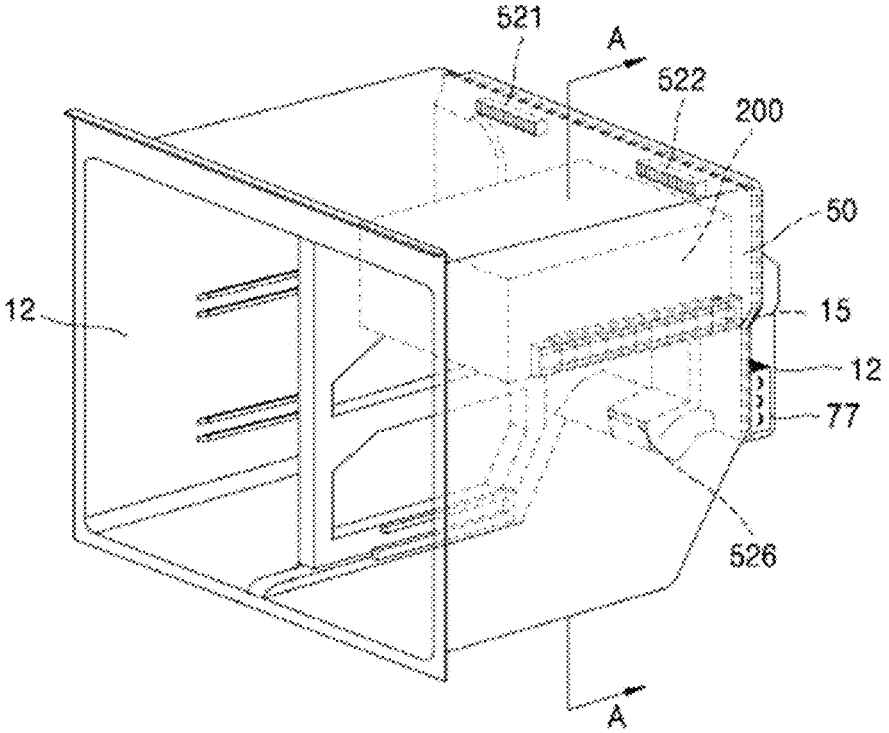
FIG. 2 is a perspective view illustrating an inner structure of an inner case of the refrigerator.

FIG. 1 is a perspective view of a refrigerator with a door opened according to an embodiment. Also, FIG. 2 is a perspective view illustrating an inner structure of an inner case of the refrigerator.

As illustrated in the drawings, a refrigerator according to an embodiment includes a refrigerator main body 10 and a refrigerator door 20 disposed on a front portion of the main body 10 to open and close each spaces of the main body 10. The refrigerator according to an embodiment has a bottom freezer type structure in which a refrigerating compartment 30 is disposed at an upper side, and a freezing compartment 40 is disposed at a lower side. The refrigerating compartment and the freezing compartment include side-by-side doors 21 and 22 that rotate with respect to hinges 25 disposed on both ends to open the refrigerating compartment and the freezing compartment. However, the embodiments are not limited to the refrigerator having the bottom freezer type structure. For example, the embodiments may be applied to a refrigerator having the side by side structure in which the refrigerating compartment and the freezing compartment are respectively disposed at left and right sides and a refrigerator having a top mount type structure in which the freezing compartment is disposed above the refrigerating compartment as lone as a cryogenic freezing compartment is capable of being installed in the freezing compartment.

The refrigerator main body 10 includes an outer case 11 defining an outer appearance of the refrigerator and an inner case 12 installed to be spaced a predetermined distance from the outer case 11 and defining an inner appearance of the refrigerator. An insulation material may be foamed and filled into a space between the outer case 11 and the inner case 12 to insulate the refrigerating compartment 30 and the freezing compartment 40 from an indoor space.

A shelf 13 and a drawer 14 are installed in the storage space of each of the refrigerating compartment 30 and the freezing compartment 40 to store foods while improving space utilization efficiency. The shelf 13 and the drawer 14 may be installed in the storage space so as to be guided along rails 15 disposed on left and right sides. A door basket 27 is installed inside the refrigerating compartment door 21 and the freezing compartment door 22 as illustrated in the drawings to store containers such as beverage bottles.

A cryogenic freezing compartment 200 according to an embodiment is provided in the freezing compartment 40. A space of the freezing compartment 40 is horizontally divided to be efficiently used. Here, the space of the freezing compartment 40 is partitioned by a partition wall 42 disposed at a center of the freezing compartment 40 and having a shape that vertically extends. Referring to FIG. 2, the partition wall 42 is installed to be fitted inward from the front portion of the main body and supported within the freezing compartment 40 through an installation guide 42-1 disposed on the bottom of the refrigerator. According to an embodiment, the cryogenic freezing compartment 200 may be disposed at a left upper portion of the freezing compartment 40 as one example. However, the position of the cryogenic freezing compartment 200, which is disposed in the freezing compartment 40, is not limited thereto. That is, the cryogenic freezing compartment 200 may be installed in the refrigerating compartment 30. However, when the cryogenic freezing compartment 200 is disposed in the freezing compartment 40, since a temperature difference between the inside and the outside (a freezing compartment atmosphere) of the cryogenic freezing compartment is more less, it is more advantageous that the cryogenic freezing compartment 200 is installed in the freezing compartment 40 in views of cold air leakage prevention.

A machine room isolated from the freezing compartment is disposed in a rear lower portion of the freezing compartment 40. A compressor 71 and a condenser 73 of a refrigeration cycle cooling device 70 using a refrigerant are disposed in the machine room. A grill fan assembly 50 including a grill fan 51 defining a rear wall of the freezing compartment 40 and a shroud 56 coupled to a rear portion of the grill fan 51 to distribute cold air within a cooling chamber is installed between a space defining the freezing compartment 40 and a rear wall of the inner case 12. Also, an evaporator 77 of the refrigeration cycle cooling device 70 is installed in a predetermined space between the grill fan assembly 50 and the rear wall of the inner case 12. When the refrigerant within the evaporator 77 is evaporated, the refrigerant is heat-exchanged with air flowing through the inner space of the freezing compartment 40. The air cooled by the heat exchange is distributed into a cold air distribution space defined by the grill fan 51 and the shroud 56 to flow through the freezing compartment 40, thereby performing the cooling in the freezing compartment 40.

Figure 3:
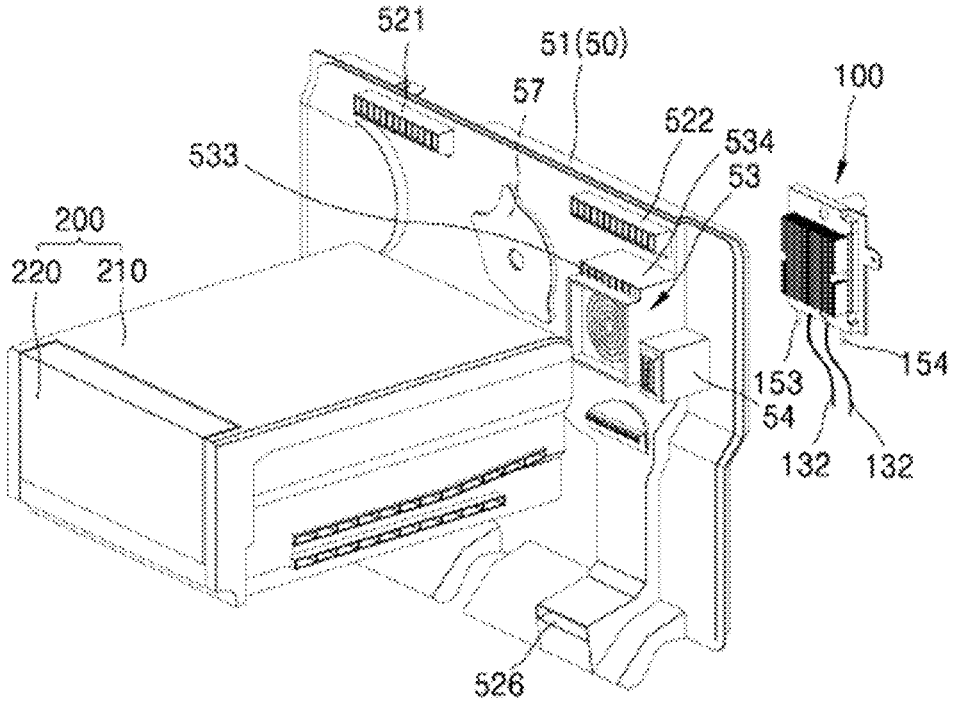
FIG. 3 is an exploded front perspective view of a coupling structure of a grill fan assembly, a cryogenic freezing compartment, and a thermoelectric module assembly according to an embodiment.
Figure 4:
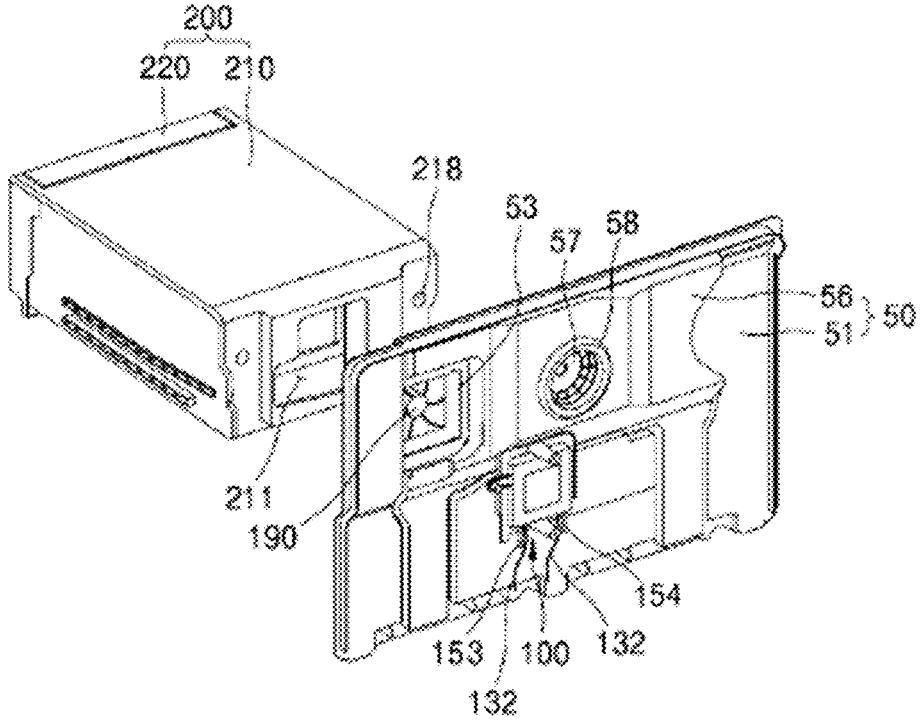
FIG. 4 is an exploded rear perspective view of the coupling structure of the grill fan assembly, the cryogenic freezing compartment, and the thermoelectric module assembly.

FIG. 3 is an exploded front perspective view of a coupling structure of the grill fan assembly, the cryogenic freezing compartment, and a thermoelectric module assembly according to an embodiment. Also, FIG. 4 is an exploded rear perspective view of the coupling structure of the grill fan assembly, the cryogenic freezing compartment, and the thermoelectric module assembly.

As illustrated in the drawings, according to an embodiment, the grill fan assembly 50 to which the cryogenic freezing compartment is applied includes the grill fan 51 defining the rear wall of the freezing compartment 40 and the shroud 56 for distributing the cold air, which is cooled by being heat-exchanged with the evaporator 77 on a rear surface of the grill fan 51, to supply the cold air into the freezing compartment 40.

As illustrated in the drawings, cold air discharge holes 52 provided as passages through which the cold air is discharged forward are defined in the grill fan 51. In this embodiment, the cold air discharge holes 52 are defined in upper end left/right sides 521 and 522, central left/right sides 523 and 524, and lower left/right sides 526 (in FIG. 3, the cold air discharge holes 52 defined in the central left side and the lower left side are covered by the cryogenic freezing compartment).

The shroud 56 is coupled to the rear portion of the grill fan 51 to define a predetermined space together with the grill fan 51. This space is a space in which the air cooled in the evaporator 77 provided in the rear surface of the grill fan assembly 50 or the shroud 56 is distributed. A cold air suction hole 58 communicating with a space defined at a rear side of the shroud 56 and a space between the grill fan 51 and the shroud 56 is defined in an approximately central upper portion of the shroud 56. Also, a fan 57 that suctions the cold air of the rear space of the shroud 56 through the cold air suction hole 58 to distribute and pressing the cold air into the space between the grill fan 51 and the shroud 56 is installed inside the cold air suction hole 58 in the space between the grill fan 51 and the shroud 56.

The cold air pressed by the fan 57 flows through the space between the grill fan 51 and the shroud 56 and then adequately distributed. Then, the cold air is discharged forward through the cold air discharge holes 52 that are opened forward.

A thermoelectric module accommodation part 53 in which a thermoelectric module assembly 100 for performing cryogenic cooling of the cryogenic freezing compartment 200 is installed is provided between the cold air discharge hole 522 defined in the right upper end and the cold air discharge hole 524 defined in the right central portion as the right upper portion of the grill fan 51.

Figure 21:
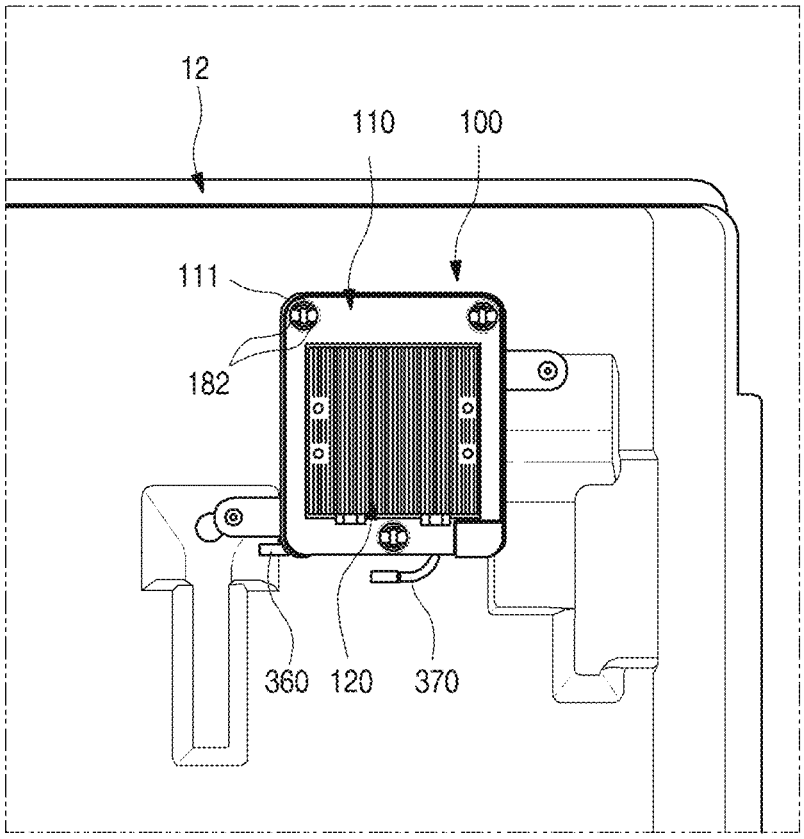
FIG. 21 is a partial front view illustrating a state in which the thermoelectric module assembly is mounted on the inner case.

The thermoelectric module accommodation part 53 is disposed on a front surface of the grill fan 51, which corresponds to a position at which the cryogenic freezing compartment 200 is installed, in the freezing compartment 40. The thermoelectric module accommodation part 53 may be installed in a manner in which the thermoelectric module accommodation part 53 is integrally molded with a wall defining a rear boundary of the freezing compartment 40 that is one of the storage space in which the cooling is performed by the refrigeration cycle cooling device 70, i.e., the grill fan 51 or separately manufactured with respect to the wall and then assembled with the wall. For example, the grill fan 51 may be manufactured through injection molding. Here, the grill fan 51 may be molded together with a portion corresponding to the thermoelectric module accommodation part 53. On the other hand, even when the rear boundary of the storage space may be defined by the inner case 12, and it is difficult to mold the thermoelectric module accommodation part 53 together while the inner case 12 is molded, as illustrated in FIG. 21, the thermoelectric module accommodation part 53 may be separately manufactured and then fixed to and assembled with the wall.

The thermoelectric module accommodation part 53 has an approximately rectangular parallelepiped shape (a rear side thereof is opened to the cooling chamber in which the evaporator is provided) extending to protrude forward from the front surface of the grill fan 51. When viewed from at a front side, this shape may have an approximately rectangular shape that is vertically long. When viewed from the front side, a grill part 531 through which the air cooled by the thermoelectric module assembly 100 is discharged is disposed at a central portion of the rectangular shape, and a suction part 533 that is opened forward is disposed on each of upper and lower portions of the rectangular shape. The suction part 533 may serve as a passage through which air outside the suction part 533 is suctioned into an inner space (that is a space defined at a rear side of the grill part 531 and an inner space of an outer circumferential wall of the rectangular shape defining an outer appearance of the thermoelectric module accommodation part 53) of the thermoelectric module accommodation part 53. The inner space of the thermoelectric module accommodation part 53 may communicate with a space defined at a front side rather than the thermoelectric module accommodation part 53 through the grill part 531 and the suction part 533 and be isolated from a space defined at a front side of the grill fan 51.

A discharge guide 532 having a partition wall shape extending forward between the grill part 531 and the suction part 533 is provided between the grill part 531 and the suction part 533 to prevent the cold air discharged from the grill part 531 from being immediately reintroduced into the suction part 533 that is adjacent thereto. To prevent the air discharged from the grill part 531 from being immediately reintroduced into the suction part 533, the discharge guide 532 may be disposed within only a range in which the grill part 531 and the suction part 533 are adjacent to each other.

However, when it is desired to further enhance an effect of the cold air discharged from the grill part 531 to flow forward, i.e., an effect of improving straightness, the discharge guide 532 may entirely surround the grill part 531 as illustrated in the drawings. Although the discharge guide 532 has a flow cross-section with a square shape as illustrated in the drawings, the discharge guide may have a flow cross-section with a circular shape like a shape of the grill part 531 or a blade of the fan disposed at the rear side of the grill part 531. The flow cross-sectional shape does not necessarily have a rectangular or circular flow cross-section, but may be modified into various shapes as long as it may improve the straightness of the cold air while preventing the cold air discharged from the grill part from being reintroduced into the suction part.

Also, the formed position of the suction part 533 is not limited to the upper and lower positions of the cooling fan 190. That is, the suction part may also be disposed at right and right sides of the cooling fan 190. The installed position thereof may be provided at one or more selected positions of the upper, lower, left, and right sides of the cooling fan 190.

The thermoelectric module accommodation part 53 has an opened rear side. Also, the thermoelectric module assembly 100 is inserted forward from the rear side of the grill fan 51 and is accommodated in the thermoelectric module accommodation part 53.

A sensor installation part, in which a sensor for detecting a temperature and humidity of the cryogenic freezing compartment 200 is installed, continuously installed at a side of the thermoelectric module accommodation part 53. A defrost sensor is installed on the sensor installation part 54 to detect a defrosting time of a cold sink that will be described later, thereby determining whether defrosting is required. The sensor installation part 54 may be disposed at a position that may represent a state of the cryogenic freezing space when the space of the cryogenic freezing space is measured.

According to an embodiment, since the suction part 533 is disposed at each of the upper and lower portions of the thermoelectric module accommodation part 53, it is advantageous for more accurate measurement that the sensor installation part 54 is installed to avoid the position. Thus, in this embodiment, the sensor installation part 54 may be installed on one side surface of the thermoelectric module accommodation part 53. Also, a through-hole is defined forward in the sensor installation part 54. Thus, an air atmosphere in the front of the sensor installation part may be transmitted to the inner space of the sensor installation part 54.

The thermoelectric module assembly 100 is inserted forward from the rear side of the grill fan assembly 50 and is accommodated into and fixed to the thermoelectric module accommodation part 53. In detail, an outer circumferential surface of the cooling fan 190 having a box fan shape is disposed to face an inner circumferential surface of the thermoelectric module accommodation part 53 at the front side of the thermoelectric module accommodation part 53, and in a state in which the position is restricted, the outer circumferential surface of the cooling fan 190 is fixed to a front surface of the thermoelectric module accommodation part 53 by using a fixing unit such as a screw. Also, the thermoelectric module assembly 100 is inserted forward from the rear side of the grill fan assembly 50 so as to be disposed at the rear side of the cooling fan 190 and then coupled and fixed to the grill fan assembly 50 by using the fixing unit such as the screw.

Although described below, a passage through which the refrigerant passes is provided in the heat sink 300 of the thermoelectric module assembly 100, and a refrigerant inflow tube 360 and a refrigerant outflow tube 370 through which the cold air is introduced and discharged are provided in the heat sink 300. While the refrigerator is assembled, the refrigerant inflow tube 360 and the refrigerant outflow tube 370 provided in the heat sink 300 of the thermoelectric module assembly 100 have to be welded to refrigerant tubes, through which the refrigerant flows, in the refrigeration cycle cooling device 70 of the refrigerator. Particularly, the inflow tube 360 may be connected to a rear end of the condenser, i.e., a rear side of an expansion device such as a liquid receiver and a capillary tube, and the outflow tube 370 may be connected to a front side of the evaporator.

Figure 13:
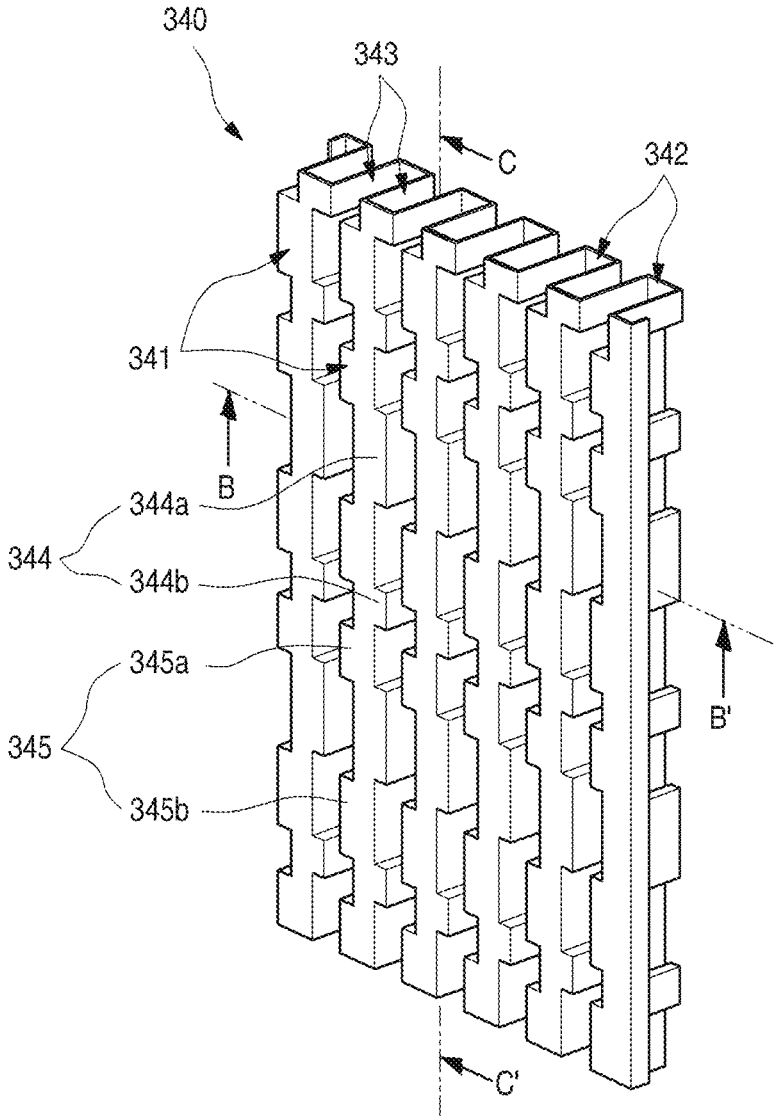
FIG. 13 is a perspective view of a heat exchange fin that is a main component of the heat sink.

As described above, the thermoelectric module assembly 100 is fixed to be spaced a predetermined distance from the inner case 12 through a spacer 111 in the form of a module in which components (the cold sink, the thermoelectric module, the heat sink, and a module housing) illustrated in FIG. 13 are assembled. Thus, a worker may more easily perform the welding operation in the space that is secured by the spacer 111, and after the welding of the refrigerant tube is finished, the grill fan assembly 50 is installed at a rear side of the freezing compartment to fix the grill fan assembly 50 to the thermoelectric module assembly 100. The spacer 111 is fixed to the inner case 12 through a screw or is fixed to the inner case 12 in a manner in which a protrusion protruding from the inner case 12 is fitted into a hole defined in a rear portion of the spacer 111.

Figure 5:
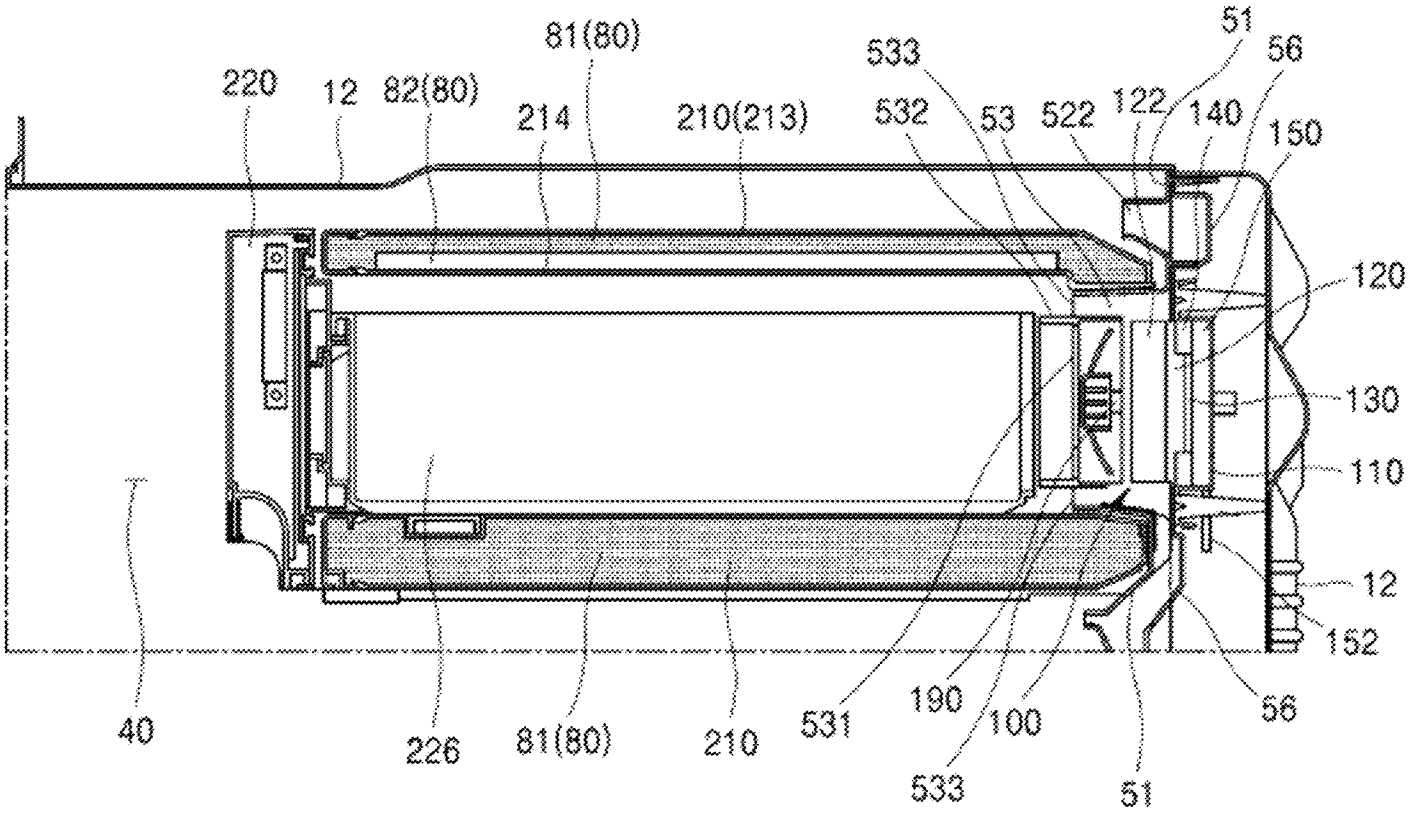
FIG. 5 is a cross-sectional view taken along line A-A of FIG. 2.

FIG. 5 is a cross-sectional view taken along line A-A of FIG. 2.

As illustrated in FIG. 5, a cryogenic case 210 has an opened front side, and an opening 211 is defined in a portion of a rear portion of the cryogenic case 210. As a result, the cryogenic case 210 has a box shape having an approximately parallelepiped shape, and a rail structure extending in a front and rear direction is provided on left and right surfaces and then fixedly mounted on the inside of the refrigerator.

The cryogenic case 210 includes an outer case 213 facing the space of the freezing compartment 40 and an inside case 214 disposed inside the outer case 213 and coupled to the outer case 213 to define a predetermined space between the outer case 213 and the inside case 214. The insulation material 80 is disposed in the space between the outer case 213 and the inside case 214 to thermally insulate the inner space of the cryogenic freezing compartment and the freezing compartment 40. A foamed insulation material 81 such as polyurethane may be used as the insulation material. The foamed insulation material is configured to fix the outer case 213 to the inside case 214 in addition to the insulation function. A vacuum insulated panel 82 having better insulation efficiency may be further applied to the wall of the cryogenic case 210 that has to have a thin thickness.

The opened front side of the cryogenic case 210 is opened and closed by a cryogenic compartment door 220. The cryogenic compartment door 220 has a predetermined space. Also, an insulation material is provided in the space to thermally insulate the inner space of the cryogenic freezing compartment 200 from the space of the freezing compartment 40. The cryogenic compartment door 220 may have a predetermined thickness for user's gripping feeling, and the foamed insulation material may be foamed into a hollow to securer rigidity.

A cryogenic tray 526 accommodated into the inner space of the cryogenic case 210 is fixedly installed at the rear side of the cryogenic compartment door 220. The cryogenic tray 226 may be integrally behaved with the cryogenic compartment door 220. When the cryogenic compartment door 220 is withdrawn forward, the cryogenic tray 226 is slidably withdrawn forward from the cryogenic case 210. The cryogenic compartment door 220 is guided by an external rail disposed on a lower or bottom surface of the cryogenic case 210 to slidably move forward and backward.

A portion of a rear wall of the cryogenic tray 226 may be opened so that the cold air that is cryogenically cooled in the thermoelectric module assembly 100 is introduced into the cryogenic tray 226 when the cold air flows forward by the cooling fan 190. Thus, when the cryogenic freezing compartment 200 is installed in the freezing compartment 40, since the opened rear surface of the cryogenic tray 226 faces the thermoelectric module accommodation part 53, the cryogenic cold air supplied to the front side by the cooling fan 190 from the thermoelectric module accommodation part 53 may be smoothly introduced into the inner space of the cryogenic tray 226.

The cryogenic case 210 has a top surface that is slightly spaced apart from a bottom surface of an upper member of the inner case 12, i.e., a ceiling surface. According to an embodiment, the top surface of the cryogenic case 210 and the bottom surface of the upper member of the inner case 12 may cooperate with each other to realize a duct-like structure. Thus, the air discharged from the cold air discharge hole 522 defined in the upper end of the grill fan 51 may be guided forward along the duct-like structure to smoothly flow. Thus, even though the cryogenic case 210 is installed, the cold air may smoothly reach the door basket 27 installed in the inner upper portion of the freezing compartment door 22.

To realize the above-described duct-like structure, an upper wall of the cryogenic case 210 has to have a thin thickness. That is, when the upper portion of the cryogenic case 210 has a thin thickness, the duct-like structure may be realized while securing an inner volume of the cryogenic case. In this respect, according to an embodiment, the foamed insulation material 81 may be foamed in a remaining space in state in which the vacuum insulated panel 82 is built in the upper member of the cryogenic case 210 so that the upper member of the cryogenic case 210 has the thin thickness. The foamed insulation material may be filled into the inner spaces of the outer case and the inside case 214, which are not filled by the vacuum insulated panel 82. Thus, coupling force between the outer case 213 and the inside case 214 may be improved in addition to the insulation performance.

Furthermore, since the cold air discharge hole 524 that is disposed in the vicinity of the middle height of the grill fan 51 is disposed in the lower portion of the cryogenic case 210, the discharged cold air may smoothly flow forward.

The thermoelectric module assembly 100 is an assembly in which the cold sink 120, the thermoelectric module 130, the insulation material 140, and the heat sink 300 are stacked and installed in the module housing 110 to form a module shape. The cold sink 120, the thermoelectric module 130, the insulation material 140, and the heat sink 300 are inserted into and fixed to an accommodation groove 113 of the module housing 110 in the state in which the cold sink 120, the thermoelectric module 130, the insulation material 140, and the heat sink 300 are closely attached and stacked by a closely attaching unit such as the screw.

Also, the thermoelectric module assembly 100 may be mounted in a manner in which the module housing 110 is closely attached and fixed to a rear surface of the grill fan assembly 50. A specific structure of the thermoelectric module assembly 100 will be described below in more detail.

Figure 6:
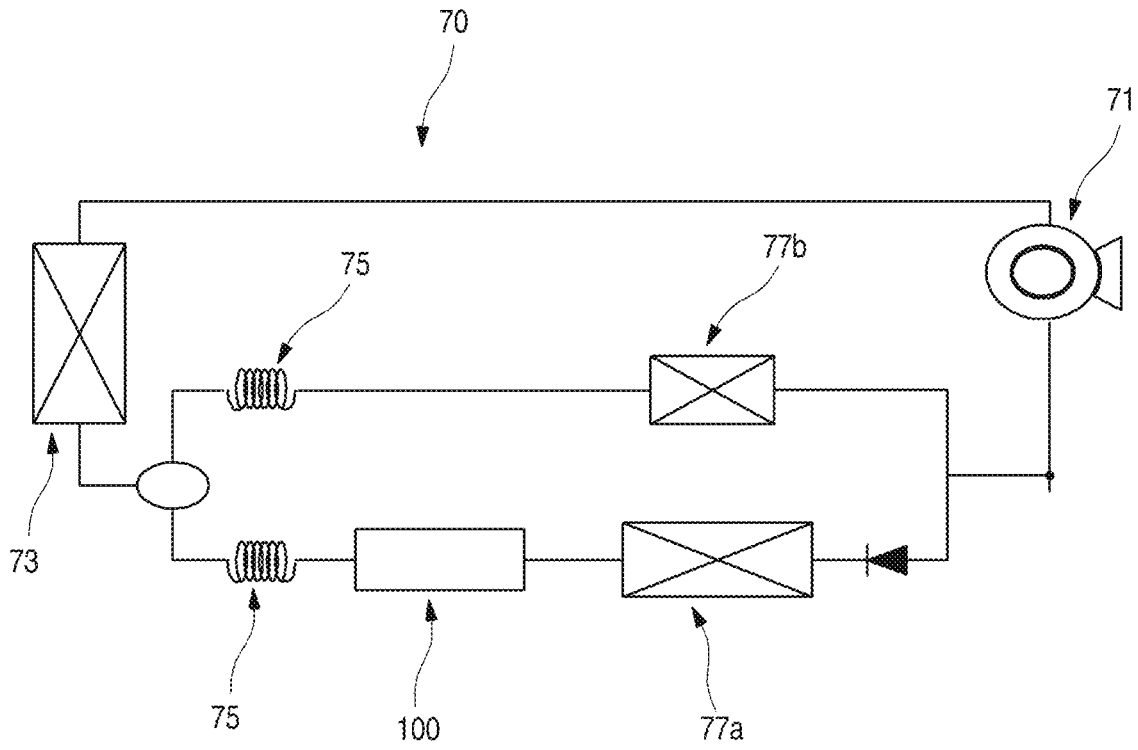
FIG. 6 is a schematic view illustrating a configuration of a refrigeration cycle cooling device of the refrigerator.

FIG. 6 is a schematic view illustrating a configuration of the refrigeration cycle cooling device of the refrigerator.

The refrigeration cycle cooling device 70 of the refrigerator according to an embodiment is a device for discharging heat inside the freezing compartment to the outside through the refrigerant passing through a thermodynamic cycle of evaporation, compression, condensation and expansion. The refrigeration cycle cooling device according to an embodiment includes an evaporator 77 in which a liquid refrigerant in a low-pressure atmosphere is evaporated by heat exchange with air in the cooling chamber (a space between the grill fan assembly and the inner housing), a compressor 71 for pressing a gas refrigerant vaporized in the evaporator and discharging a high-temperature high-pressure gas refrigerant, a condenser 73 for condensing the high-temperature high-pressure gas refrigerant discharged from the compressor 71 by heat exchange with air in the outside (machine room) of the refrigerator to discharge heat, and an expansion device 75 such as a capillary tube, which drops down a pressure of the refrigerant condensed in the condenser 73 to a low temperature atmosphere. The low-temperature low-pressure liquid refrigerant that decreases in pressure in the expansion device 75 is reintroduced into the evaporator 77.

According to an embodiment, since heat of the heat sink 300 of the thermoelectric module assembly 100 has to be quickly cooled, the low-temperature low-pressure liquid refrigerant that decreases in pressure and temperature after passing through the expansion device 75 has to pass through the heat sink 300 of the thermoelectric module assembly 100 before being introduced into the evaporator 77.

Thus, the refrigerant discharged via the capillary tube is introduced into the heat sink 300 through the refrigerant inflow tube 360 to cool or absorb heat generated from a heat generation surface of the thermoelectric module 130 and then is discharged from the refrigerant outflow tube 370 and reintroduced into the evaporator 77.

The liquid refrigerant may quickly absorb the heat generated from the heat generation surface **130*b* of the thermoelectric module 130 through a thermal conductive manner using the heat sink 300 while passing through the heat sink 300. Thus, the heat of the heat sink 300 may be quickly cooled by the refrigerant circulating through the heat sink 300**.

In detail, the compressor 71 presses the low-temperature low-pressure gas refrigerant to discharge the high-temperature high-pressure gas refrigerant. Also, the refrigerant is condensed, i.e., liquefied while releasing the heat in the condenser 73. As described above, the compressor 71 and the condenser 73 are disposed in the machine room of the refrigerator.

The high-temperature high-pressure liquid refrigerant that is liquified by passing through the condenser 73 may be introduced into the evaporator 77 in the depressurized state by passing the expansion device 75 such as the capillary tube. In the evaporator 77, the refrigerant is evaporated while absorbing heat therearound. According to the embodiment of FIG. 6, the refrigerant passing through the condenser 73 is branched into a refrigerating compartment-side evaporator **77*b* or a freezing compartment-side evaporator 77*a*. Here, the heat sink 300 of the thermoelectric module assembly 100 is disposed at the front side of the freezing compartment-side evaporator 77*a* and disposed at the rear side of the expansion device 75** in the refrigerant flow path.

The cryogenic freezing compartment is a space in which a maximum freezing temperature of a temperature of about −50 degrees Celsius is to be maintained. Thus, when the heat generation surface **130*b* of the thermoelectric module 130 is maintained in a very cool state, the heat absorption surface 130*a* may be easily maintained in a colder state. Thus, a portion of the heat sink 300 through which the refrigerant flows may be disposed at the front side rather than the freezing compartment-side evaporator 77*a* in the refrigerant flow path and thus be maintained in the colder state. Particularly, since the heat sink 300 comes into direct contact with the thermoelectric module 130 to absorb heat from the thermoelectric module 130 in the conductive manner through a heat conductor such as metal, the heat generation surface 130*b* of the thermoelectric module 130** may be surely cooled.

Also, while the cooling of the cryogenic freezing compartment 200 is performed, i.e., the refrigerant within the heat sink 300 cools the heat generation surface **130*b* of the thermoelectric module 130**, the compressor may operate at a maximum output or an output higher than a set output to prevent the cooling efficiency of the freezing compartment from being deteriorated.

When the cryogenic freezing compartment 200 is to be used at a temperature of about −20 degrees Celsius as in the normal freezing compartment without being cooled to a cryogenic temperature of about −50 degree Celsius, it is possible to be used as a general freezing compartment only by not supplying power to the thermoelectric module 130. In this case, if power is not applied to the thermoelectric module 130, the heat absorption and the heat generation do not occur in the heat sink of the thermoelectric module 130.

Thus, the refrigerant passing through the heat sink 300 is introduced into the freezing compartment-side evaporator 77*a* in the liquid refrigerant state that is not evaporated because of not absorbing heat.

That is, the cold air generated in the refrigerant cycle cooling device through the general compression manner may be supplied to the freezing compartment 40 and the refrigerating compartment 30 of the refrigerator. When the cryogenic freezing compartment operates, the refrigerant passing through the expansion device 75 may quickly absorb heat generated from the heat generation surface of the thermoelectric module 130 by passing through the heat sink 300 of the thermoelectric module assembly 100 so that the heat generated form the heat generation surface of the thermoelectric module 130 is quickly discharged and then is introduced into the evaporator 77*a*.

Although the refrigeration cycle cooling device 70 in which the evaporators 77*a* and 77*b* are provided in plurality to individually cool the refrigerating compartment 30 and the freezing compartment 40 is described as an example in this embodiment, the embodiment may be equally applied to a refrigeration cycle cooling device in which all the refrigerating compartment 30 and the freezing compartment 40 are cooled by using one evaporator 77*a*.

Hereinafter, a structure of the thermoelectric module assembly 100 will be described in more detail.

Figure 7:
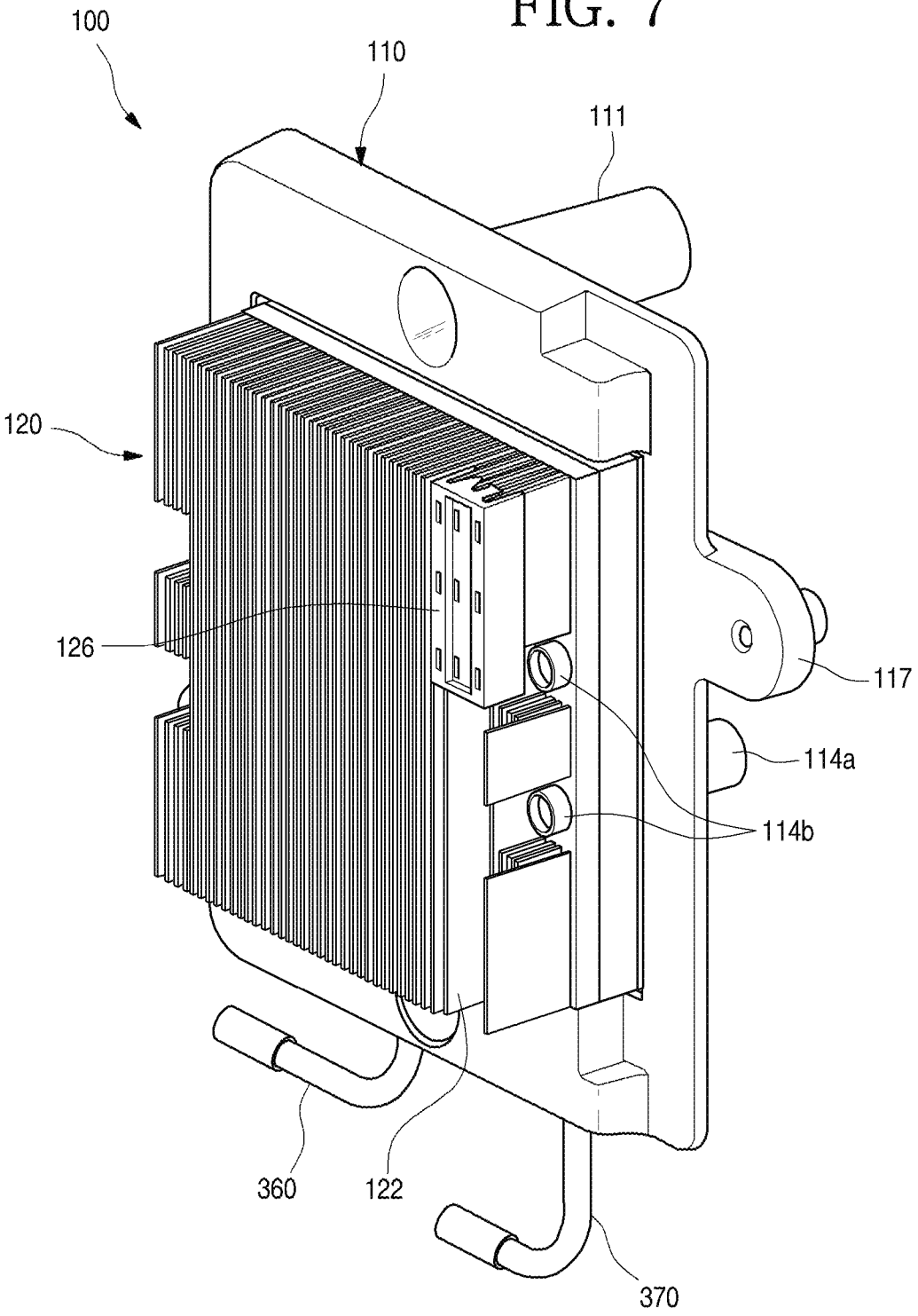
FIG. 7 is a front perspective view of the thermoelectric module assembly.
Figure 8:
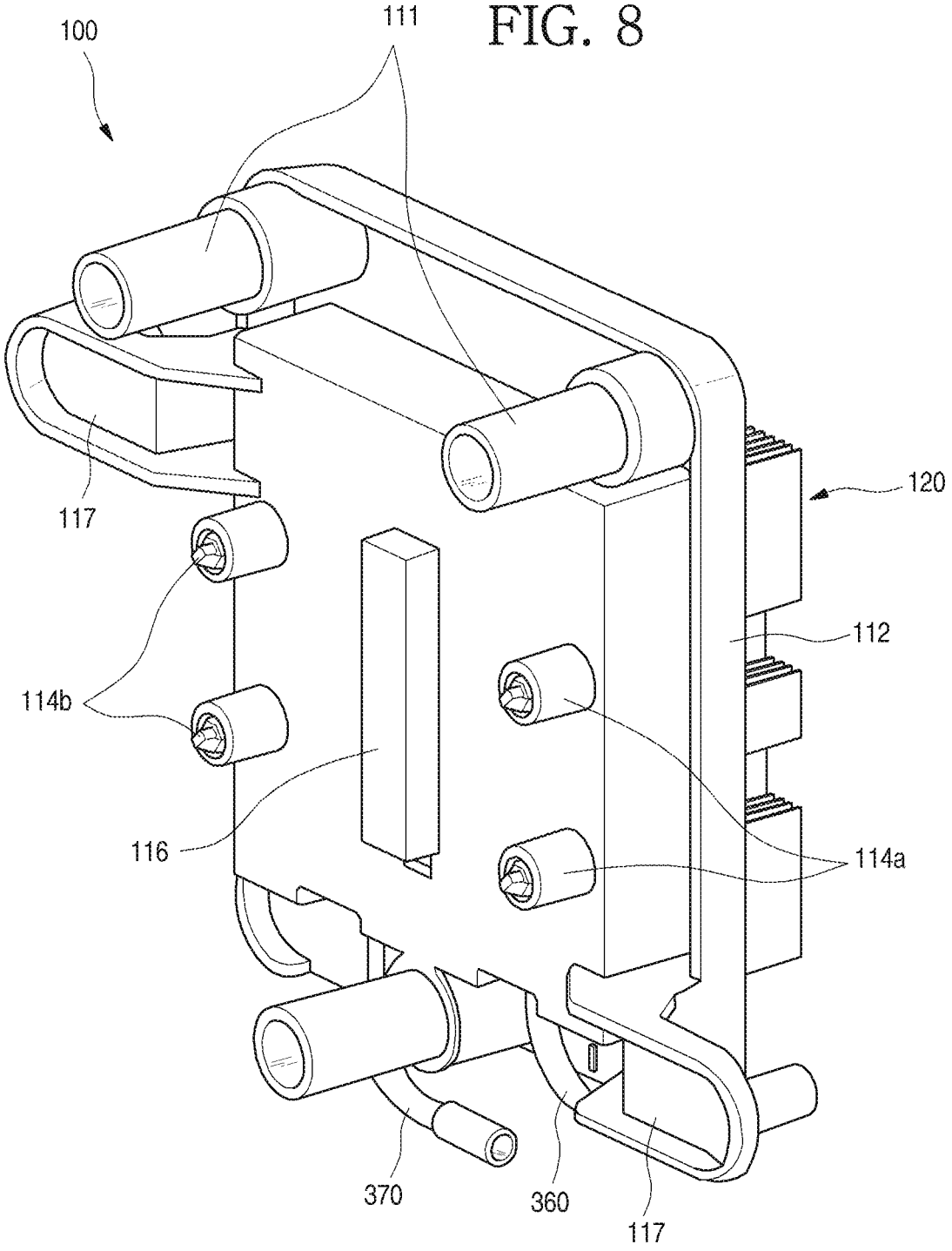
FIG. 8 is a rear perspective view of the thermoelectric module assembly.
Figure 9:
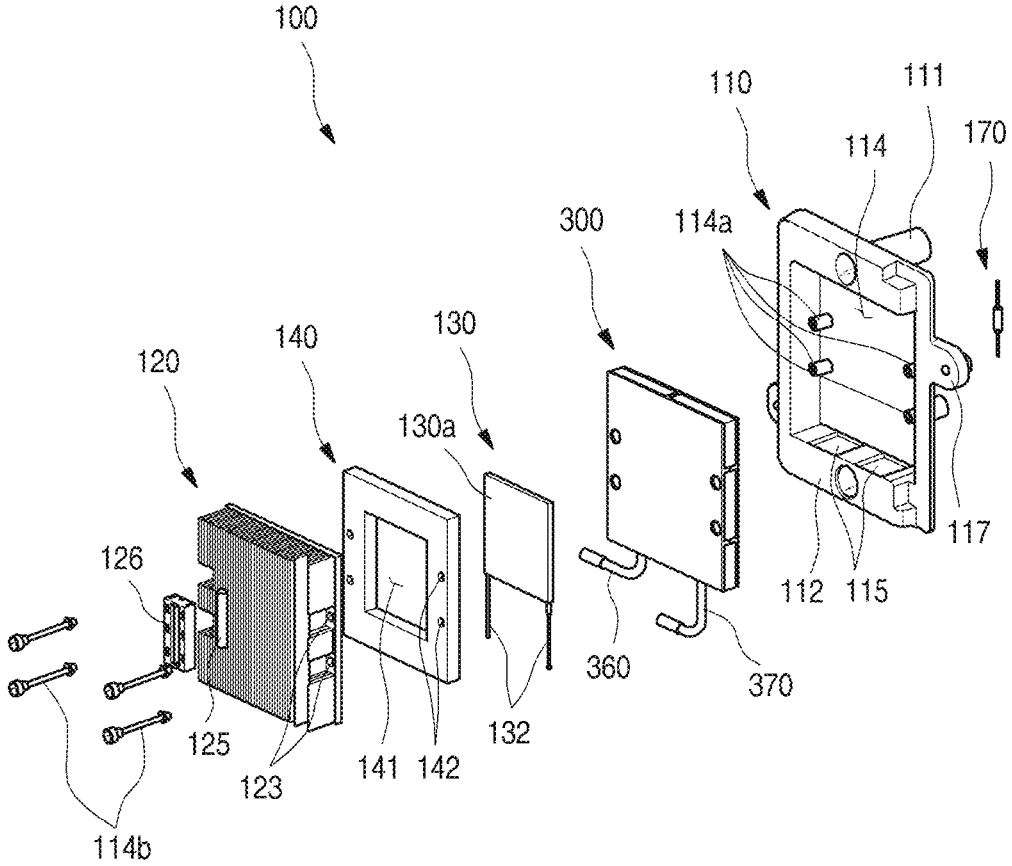
FIG. 9 is an exploded front perspective view illustrating a coupling structure of the thermoelectric module assembly.
Figure 10:
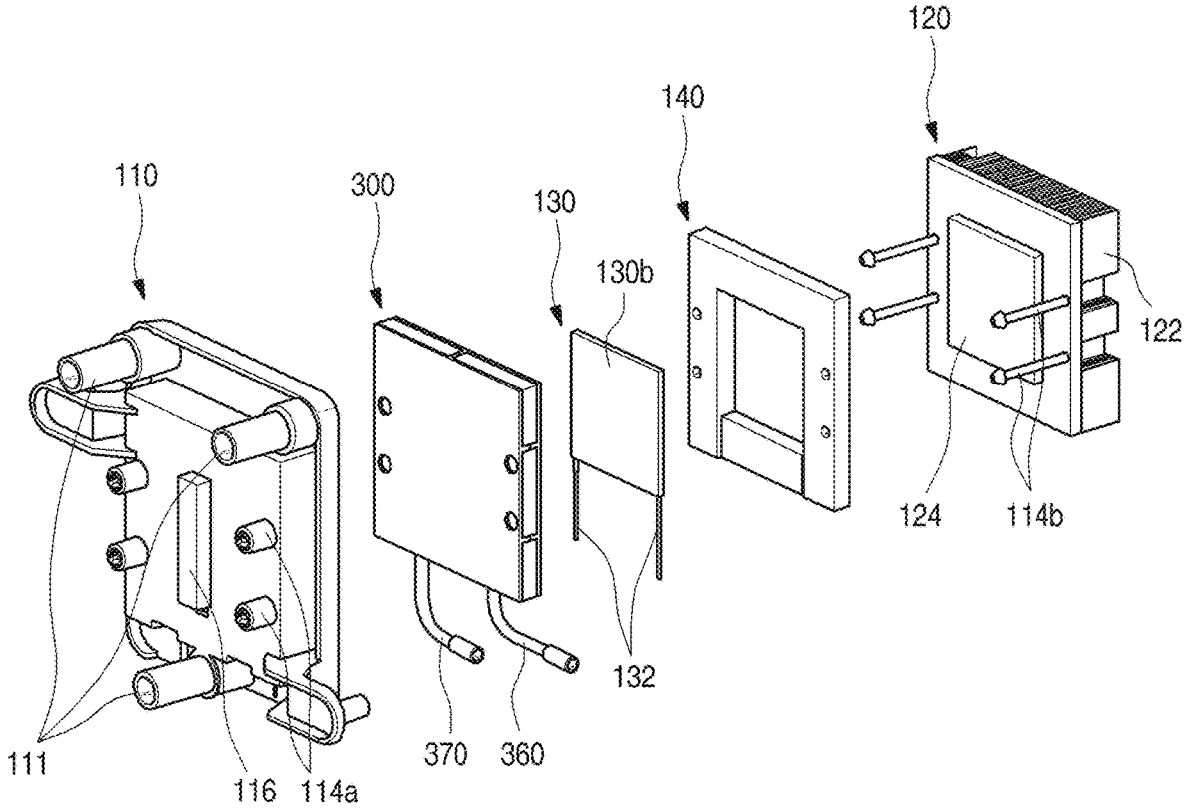
FIG. 10 is an exploded rear perspective view illustrating the coupling structure of the thermoelectric module assembly.

FIG. 7 is a front perspective view of the thermoelectric module assembly. FIG. 8 is a rear perspective view of the thermoelectric module assembly. FIG. 9 is an exploded front perspective view illustrating a coupling structure of the thermoelectric module assembly. FIG. 10 is an exploded rear perspective view illustrating the coupling structure of the thermoelectric module assembly.

As illustrated in the drawings, a thermoelectric module assembly 100 according to another embodiment may include a thermoelectric module 130, a cold sink 120, a heat sink 300, an insulation material 140, and a module housing 110.

The thermoelectric module 130 is a device using a Peltier effect. The Peltier effect refers to a phenomenon in which, when a DC voltage is applied to both ends of two different elements, heat is absorbed into one side, and heat is generated from the other side according to a direction of current.

The thermoelectric module has a structure in which an n-type semiconductor material, in which electrons are the main carriers, and a p-type semiconducting material, in which holes are carriers, are alternately connected in series. Here, an electrode portion for allowing current to flow from the p-type semiconductor material to the n-type semiconductor material is disposed on a first surface, and an electrode portion for allowing current to flow from the n-type semiconductor material to the p-type semiconductor material with reference to any one direction in which the current flows. Thus, when the current is supplied in a first direction, the first surface becomes the heat absorption surface, and the second surface becomes the heat generation surface. When the current is supplied in a second direction opposite to the first direction, the first surface becomes the heat generation surface, and the surface becomes a heat absorption surface.

According to an embodiment, the thermoelectric module assembly 100 is inserted and fixed forward from the rear side of the grill fan assembly 50, and the cryogenic freezing compartment 200 is provided at the front side of the thermoelectric module assembly 100. Thus, the heat absorption occurs on a surface facing a surface defining a front side of the thermoelectric module, i.e., a surface facing the cryogenic freezing compartment 200, and the heat generation occurs on a surface defining a rear side of the thermoelectric module, i.e., a surface having a backdrop of the cryogenic freezing compartment 200 or in a direction facing the cryogenic freezing compartment 200. Also, when current is supplied in the first direction in which the heat absorption occurs on the surface facing the cryogenic freezing compartment in the thermoelectric module, and the heat generation occurs on the opposite surface, the freezing of the cryogenic freezing compartment may be enabled.

In an embodiment, the thermoelectric module 130 has a flat plate shape having a front surface and a rear surface. Here, the front surface may be a heat absorption surface 130*a*, and the rear surface may be a heat generation surface 130*b*. The DC power supplied to the thermoelectric module 130 generates the Peltier effect. Thus, heat of the heat absorption surface 130*a* of the thermoelectric module 130 moves to the heat generation surface 130*b*. Thus, the front surface of the thermoelectric module 130 becomes a cold surface, and the rear surface becomes a heat generation portion. That is, it may be said that the heat within the cryogenic freezing compartment 200 is discharged to the outside of the cryogenic freezing compartment 200. The power supplied to the thermoelectric module 130 is applied to the thermoelectric module through a leading wire 132 provided in the thermoelectric module 130.

The cold sink 120 may come into contact with and be stacked on the front surface of the thermoelectric module 130, i.e., the heat absorption surface 130*a* facing the cryogenic freezing compartment 200. The cold sink 120 may be made of a metal material or an alloy material such as aluminum having high terminal conductivity. A plurality of heat exchange fins 122, each of which has a shape extending vertically, are disposed to be horizontally spaced apart from each other on the front surface of the cold sink 120.

The heat sink 300 may come into contact with and stacked on a rear surface of the thermoelectric module 130, i.e., the heat generation surface 130*b* facing the direction in which the cryogenic freezing compartment 200 is disposed. The heat sink 300 is configured to quickly dissipate or discharge the heat generated from the heat generation surface 130*b* by using the Pelitier effect. A portion corresponding to the evaporator 77 of the refrigeration cycle cooling device 70 used for the cooling of the refrigerator may be constituted by the heat sink 300. That is, when a process in which the low-temperature low-pressure liquid refrigerant passing through the expansion device 75 in the refrigeration cycle absorbs heat or a process in which the refrigerant absorbs heat and then is evaporated occurs in the heat sink 300, the refrigerant absorbs the heat generated from the heat generation surface 130*b* of the thermoelectric module 130, or the refrigerant absorbs the heat and then is evaporated to very immediately cool the heat of the heat generation surface 130*b*.

Since the cold sink 120 and the heat sink 300 are stacked on each other with the thermoelectric module 130 having a flat shape therebetween, it is necessary to isolate heat therebetween. Thus, the insulation material 140 surrounding the thermoelectric module 130 and filled into a gap between the cold sink 120 and the heat sink 300 is stacked on the thermoelectric module assembly 100. That is, the cold sink 120 has an area greater than that of the thermoelectric module 130 and also has substantially the same area as the thermoelectric module 130 and the insulation material 140. Similarly, the heat sink 300 has an area greater than that of the thermoelectric module 130 and also has substantially the same area as the thermoelectric module 130 and the insulation material 140.

It is not necessary that the cold sink 120 has the same size as the heat sink 300. That is, the heat sink 300 may have a size greater than that of the cold sink 120 to effectively discharge heat.

According to an embodiment, the refrigerant of the refrigeration cycle cooling device 70 flows through the heat sink so that the heat discharge efficiency of the heat sink 300 is instantly and reliably caused, and the refrigerant flow path is disposed over an entire area of the heat sink so that the refrigerant is evaporated in the heat sink to quickly absorb the heat from the heat generation surface of the thermoelectric module 130 as the heat of vaporization. That is, the heat sink 300 according to an embodiment is designed to have a size enough to immediately absorb and discharge the heat generated by the thermoelectric module 130, and the cold sink 120 has a size less than that of the heat sink 300. However, according to an embodiment, it should be noted that the size of the cold sink 120 increase by considering the fact that the heat sink 300 is heat-exchanged between liquid and solid, whereas the cold sink 120 is heat-exchanged between gas and solid, so that the heat exchange efficiency at the cold sink 120 further increases. As described, in a degree of the enlarged size of the cold sink 120, although the cold sink 120 is designed to have a size corresponding to the heat sink 300 in consideration of compactness of the thermoelectric module assembly 100 according to an embodiment, the cold sink 120 may have a size greater than that of the heat sink 300 to more improve the heat exchange efficiency at the cold sink 120.

The module housing 110 is configured to accommodate the thermoelectric module assembly 100 and is fixedly mounted on the grill fan assembly 50 so that the thermoelectric module assembly 100 is fixedly mounted and effectively supplies the cold air to the cryogenic freezing compartment.

The module housing 110 has an accommodation groove 114. The accommodation groove 114 may provide a space for accommodating the components constituting the thermoelectric module assembly 100. The accommodation groove 114 may be opened to the cryogenic freezing compartment 200 and have a front surface that is sealed by mounting the thermoelectric module assembly 100 on the grill fan assembly 50. Thus, the cold air generated in the cold sink 120 may be effectively supplied into the cryogenic freezing compartment, and the heat sink 300 may be heat-exchanged by the evaporator 77 without having an influence on temperature of the inside of the refrigerator and the cryogenic freezing compartment 200.

Also, a fixing boss 114*a* may be disposed inside the accommodation groove 114. The fixing boss 114*a* may extend to pass through the heat sink 300, the insulation material 140, and the cold sink 120. An opening is defined in an extending end of the fixing boss 114*a*, and the fixing boss 114*a* has a hollow therein so that the fixing member 114*b* passing through the cold sink 120 is coupled to the opening of the fixing boss 114*a*. Here, the fixing member 114*b* may include a screw, a bolt, or a corresponding constituent, which is coupled to the fixing boss 114*a*.

A plurality of constituents are fixedly mounted inside the accommodation groove 114. Here, it is necessary that the constituents are coupled by using the fixing member 114*b* to maintain the contact state and thereby to smoothly perform the heat exchange. The fixing member 114*b* has a structure that is coupled to the fixing boss 114*a*. The fixing member 114*b* may substantially come into contact with only the cold sink 120 and the fixing boss 114*a*. That is, the fixing member 114*b* may be electrically insulated from the heat sink 300 to prevent cooling performance from being deteriorated by heat transfer between the heat sink 300 and the cold sink 120.

The fixing boss 114*a* may extend to pass through through-holes 155 and 142 defined in both left and right sides of the heat sink 300 and the insulation material 140, i.e., extend up to a position coming into contact with coupling holes 123 defined in both sides of the cold sink 120. Thus, the heat sink 300, the insulation material 140, and the cold sink 120, which are mounted inside the module housing 110 may be accurately mounted in position. Also, the thermoelectric module 130, the heat sink 300, and the cold sink 120 may be maintained in the closely attached state through the coupling of the fixing member 114*b*.

Also, an edge hole 115 through which the refrigerant inflow tube 360 and the refrigerant outflow tube 370 pass may be further defined in an edge of the accommodation groove 114. The edge hole 115 may be provided in a pair so that the leading wire 132 of the thermoelectric module 130 is accessible together with the refrigerant inflow tube 360 and the refrigerant outflow tube 370. Also, the edge hole 115 may be provided so that at least a portion of a bottom surface of a circumference of the accommodation groove 114 is opened. Here, the at least a portion may be opened to the evaporator 77. Thus, the refrigerant inflow tube 360 and the refrigerant outflow tube 370 may be easily connected to each other at a position that is adjacent to the evaporator 77.

A fuse mounting part 116 that is further recessed may be disposed on a center of the accommodation groove 114. A fuse 170 for detecting overheat of the heat sink 300 may be accommodated in the fuse mounting part 116. The fuse 170 is disconnected in an overheated state of the heat sink 300 to prevent the thermoelectric module 130 from being damaged or abnormally operated.

A flange 112 is disposed on a circumference of an opened end of the accommodation groove 114. The flange 112 may be coupled to the shroud 56 and the grill fan 51 in a closely attached state. The flange 112 prevents the cold air from leaking through surface contact with the shroud 56 or the grill fan 51 and also allows the front surface of the thermoelectric module assembly 100 to be stably seated and supported on the grill fan assembly 50.

A housing coupling part 117 may be disposed on each of both sides of the flange 112. The housing coupling part 117 may be coupled to one side of the grill fan 51 or the shroud 56 by using the coupling member such as the screw. The module housing 110 may be fixedly mounted on the grill fan assembly 50. The module housing 110 may be closely attached to the grill fan assembly 50 to prevent the cold air of the thermoelectric module assembly 100 and the cryogenic freezing compartment 200 from leaking through the contact portion between the flange 112 and the grill fan assembly 50.

A spacer 111 extending backward, i.e., toward the inner case 12 may be disposed on the rear surface of the grill fan 51. The spacer 111 may support the module housing 110 to be maintained in a state spaced apart from the inner case 12. Also, the spacer 111 may be coupled to the inner case 12 so that the rear side of the thermoelectric module assembly 100 is stably fixed.

The spacer 111 may have upper and lower portions that have the same shape. The upper and lower portions of the spacer 111 may protrude at the same height so that the thermoelectric module assembly 100 is fixedly mounted in parallel to the wall of the inner case 12.

The spacer 111 may have a cylindrical shape, and both ends of the spacer 111 may be opened. That is, the spacer 111 may have a cylindrical shape of which a rear surface coming into contact with the inner case 12 and a front surface communicating with the inside of the accommodation groove 114 are straightly connected to each other. Thus, the inner case 12 and the module housing 110 may be fixedly mounted on each other by a coupling part 181 protruding from a rear wall of the inner case 12.

One end of the opened front surface of the module housing 110 may be stepped. The stepped portion may match a corresponding shape of the grill fan assembly 50 to seal the inside of the module housing 110.

The heat sink 300 may be accommodated inside the module housing 110, and then, the insulation material 140 may be stacked. The insulation material 140 may have a rectangular frame shape, and the thermoelectric module 130 may be disposed in the insulation material 140. Also, both surfaces of the thermoelectric module 130 may come into contact with the heat sink 300 and the cold sink 120. When power is applied, the heat sink 300 generates heat, and the cold sink 120 absorbs the heat.

After the insulation material 140 is stacked, the cold sink 120 may be mounted. The cold sink 120 may have a front surface having a size corresponding to the opened size of the accommodation groove 114 to cover the opened surface of the accommodation groove 114.

Also, a module contact part 124 inserted into a thermoelectric module accommodation hole 141 defined in a center of the insulation material 140 may be disposed at a center of the rear surface of the cold sink 120. The module contact part 124 has a size corresponding to the thermoelectric module accommodation hole 141 to seal the inside of the insulation material 140 and come into contact with the heat absorption surface 130*a* of the thermoelectric module 130 and then is cooled.

The fixing member 114*b* may be coupled to the coupling holes 123 defined in both sides of the cold sink 120, and thus, the cold sink 120 is coupled to the module housing 110 so that the module contact part 124 of the cold sink 120 is maintained to be closely attached to the heat absorption surface 130*a* of the thermoelectric module 130.

A temperature sensor 125 for detecting a temperature of the cold sink 120 may be disposed on one side of the front surface of the cold sink 120. The temperature sensor 125 may be fixedly mounted on one side of the heat exchange fin 122 by a sensor bracket 126.

The temperature sensor 125 may detect a temperature of the cold sink 120 to control an operation of the thermoelectric module 130. For example, the temperature sensor prevents the temperature of the cold sink 120 from increasing above a set temperature and being overheated when a reverse voltage is applied to the thermoelectric module 130 when a defrosting operation of the cryogenic freezing compartment 200 is performed.

Figure 11:
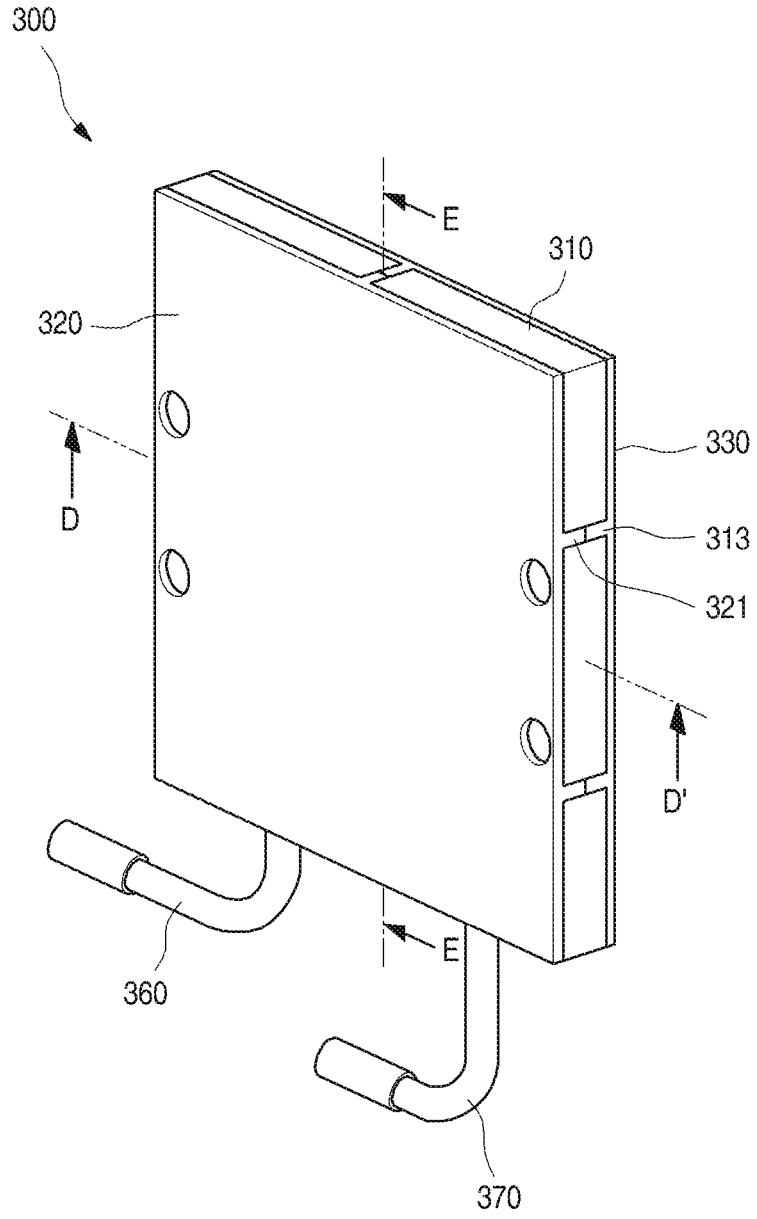
FIG. 11 is a perspective view of a heat sink according to an embodiment.
Figure 12:
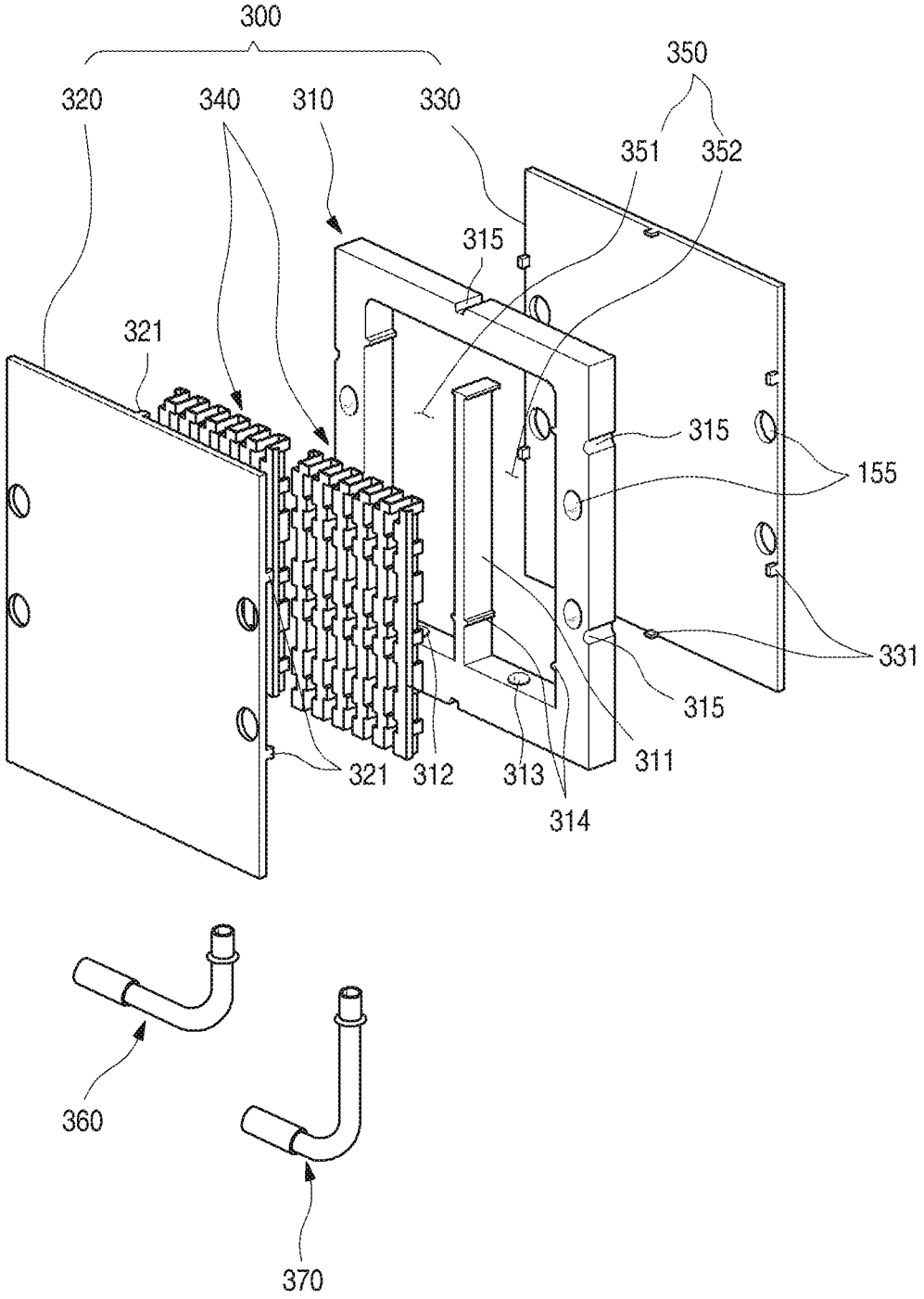
FIG. 12 is an exploded perspective view illustrating a configuration of the heat sink.

FIG. 11 is a perspective view of the heat sink according to an embodiment. FIG. 12 is an exploded perspective view illustrating a configuration of the heat sink.

As illustrated in the drawings, the heat sink 300 may have a hexahedral shape that is capable of being accommodated inside the accommodation groove 114. The heat sink 300 may have a front surface coming into contact with the heat generation surface 130*b* of the thermoelectric module 130 and be made of a metal material such as aluminum to effectively perform the heat exchange with the heat generation surface 130*b*.

The heat sink 300 may have an outer appearance as a whole by a sink body 310, a front plate 320, and a rear plate 330. Also, the refrigerant inflow tube 360 and the refrigerant outflow tube 370 may be connected to the sink body 310, and the low-temperature refrigerant may be accessible via the inside of the sink body 310 to cool the heat sink 300.

The sink body 310 may have a rectangular frame shape providing a space filled with the refrigerant. Thus, the sink body 310 may be cut and processed to a predetermined thickness after being molded by an extrusion process, and mass production and manufacturing cost may be reduced by this process. Also, a through-hole through which the fixing boss 114*a* passes may be defined in each of both left and right sides of the sink body 310.

An accommodation part 350 into which the heat exchange fin 340 is accommodated may be defined inside the sink body 310. The accommodation part 350 may have a shape through which the sink body 310 passes and be covered by the front plate 320 and the rear plate 330 to define a close space.

A barrier 311 that divides the space of the accommodation part 350 into left and right sides may be disposed inside the accommodation part 350. The barrier 311 may extend upward from an inner end of the accommodation part 350, and the extending end may be spaced somewhat from the inner end of the accommodation part 350. Also, an inflow hole 312 connected to the refrigerant inflow tube 360 and an outflow hole 313 connected to the refrigerant outflow tube 370 may be defined in both left and right sides of a lower end of the barrier 311. The inflow hole 312 and the outflow hole 313 may be defined in lower ends of a first space 351 and a second space 352 of the accommodation part 350 that are partitioned by the barrier 311.

Thus, the refrigerant introduced through the inflow hole 312 is introduced into the first space 351 to flow into the second space 352 through the spaced space defined in the end of the barrier 311 and then is discharged through the outflow hole 313. The barrier 311 may be provided in plurality so that the space of the barrier 311 is divided to successively perform the inflow and discharge of the refrigerant.

The heat exchange fin 340 may be accommodated into the accommodation part 350. The heat exchange fin 340 may allow the refrigerant flowing inside the accommodation part 350 to decrease in flow rate and may increase in contact area with the refrigerant to improve the heat exchange efficiency. Also, the heat exchange fin 340 may come into contact with the front plate 320 and the rear plate 330 to uniformly distribute heat throughout the front plate 320.

The heat exchange fin 340 may be mode of a thin plate such as aluminum having excellent heat conduction performance and may be continuously bent several times. The heat exchange fin 340 may have a left and right width to correspond to the first space 351 and the second space 352 and a vertical length slightly less than that of the barrier 311.

The heat exchange fin 340 may be fitted into the first space 351 and the second space 352 and have upper and lower ends, which are spaced somewhat from the upper and lower ends of the first space 351 and the second space 352. Thus, the refrigerant within the accommodation part 350 may move from one end to the other end of the heat exchange fin 340 to uniformly flow throughout the heat exchange fin 340.

The heat exchange fin 340 may be fixedly mounted without being shaken by the refrigerant flowing through the inside of the accommodation part 350. To maintain the mounted position of the heat exchange fin 340, a plurality of fin fixing parts 314 may be disposed inside the accommodation part 350.

The fin fixing parts 314 may restrict the upper and lower ends of the heat exchange fin 340 to fix the heat exchange fin 340. The fin fixing parts 314 may respectively protrude from upper and lower ends of the barrier 311 that are positions corresponding to the vertical length of the heat exchange fin 340 and also respectively protrude from both left and right ends of the first and second spaces 351 and 352, which face each other.

Thus, the heat exchange fin 340 may be inserted into a space between the plurality of fin fixing parts 314 protruding from both the left and right sides. In the heat exchange fin 340 is inserted, the fin fixing parts 314 may restrict the upper and lower ends of the heat exchange fin 340 in both left and right directions to prevent the heat exchange fin 340 from being shaken. Also, the heat exchange fin 340 may be spaced apart from the upper and lower ends of the accommodation part 350 by the positions of the fin fixing parts 314.

The front plate 320 and the rear plate 330 may be coupled to the front and rear surface of the sink body 310 to define outer appearances of the front and rear surfaces of the heat sink 300, respectively. Each of the front plate 320 and the rear plate 330 may have a rectangular plate shape and also may have the same size and shape as the sink body 310. That is, the front plate 320 and the rear plate 330 may be coupled to each other to completely cover the front and rear surfaces of the sink body 310.

Each of the front plate 320 and the rear plate 330 may be made of a metal material such as aluminum like the sink body 310. Also, the front plate 320 may come into contact with the heat generation surface 130*b* of the thermoelectric module 130 and be heat-exchanged with the heat generation surface 130*b*.

The front plate 320 and the rear plate 330 may be closely coupled to circumferences of the front and rear surfaces of the sink body 310. The front plate 320 and the rear plate 330 may come into surface contact with the sink body 310 so as to be coupled through brazing in a completely sealed state.

As described above, the sink body 310, the front plate 320, and the rear plate 330 may be coupled to each other through the brazing to prevent the front plate 320 or the heat exchange fin 340 within the heat sink 300 from being thermally deformed and to allow the front plate 320 coming into contact with the heat generation surface 130*b* to be maintained in a planar state. Thus, the front plate 320 may be completely closely attached to the entire surface of the heat generation surface 130*b* to prevent heat loss from occurring during the heat exchange.

If the airtightness inside the heat sink 300 is maintained, the front plate 320 and the rear plate 330 may have a different coupling structure such as an adhesive or coupling by fastening of other coupling members.

Also, restriction pieces 321 and 331 may extend from vertical left and right ends of the front plate 320 and the rear plate 330. The restriction pieces 321 and 331 may be bent from ends of the front plate 320 and the rear plate 330 and then be inserted into restriction grooves 315 defined in an outer surface of the sink body 310. Also, the restriction pieces 321 and 331 may be inserted into the restriction grooves 315 when the front plate 320 and the rear plate 330 are mounted. The front plate 320 and the rear plate 330 may be temporarily fixed by the restriction pieces 321 and 331 and the restriction grooves 315 before the coupling and fixing through the brazing to provide additional coupling force so that the front plate 320 and the rear plate 330 are more firmly fixedly mounted on the sink body 310.

In the state in which the front plate 320 and the rear plate 330 are coupled to each other, the first space 351 and the second space 352 may provide a close space, and the heat exchange fin 340 inside the first and second spaces 351 and 352 may come into contact with the front plate 320 and the rear plate 330 to guide a flow of the refrigerant and transfer heat to the front plate 320 and the rear plate 330 through conduction.

The heat exchange fin 340 may have various shapes in which a flow rate of the refrigerant is reduced, and the front plate 320 and the rear plate 330 comes into contact with each other. In this embodiment, a structure having excellent heat transfer performance will be provided as an example.

Figure 14:
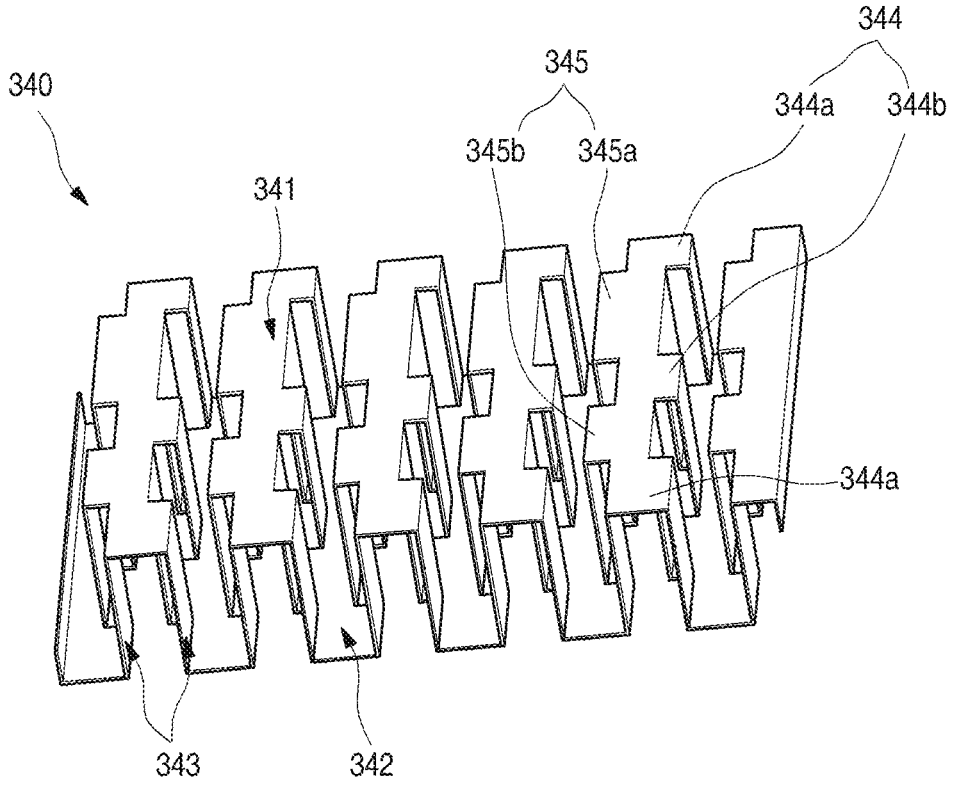
FIG. 14 is a cross-sectional view taken along line B-B' of FIG. 13.
Figure 15:
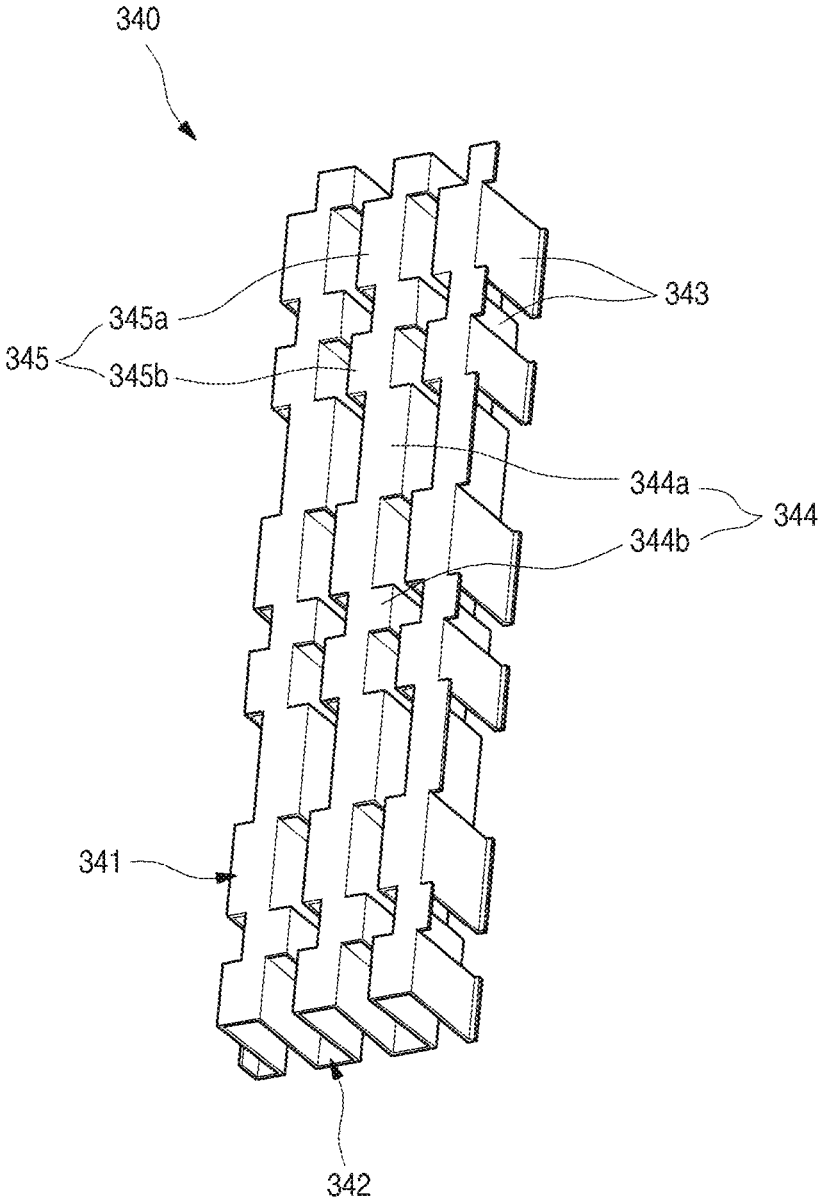
FIG. 15 is a cross-sectional view taken along line C-C' of FIG. 13.

FIG. 13 is a perspective view of the heat exchange fin that is a main component of the heat sink. FIG. 14 is a cross-sectional view taken along line B-B' of FIG. 13. FIG. 15 is a cross-sectional view taken along line C-C' of FIG. 13.

A direction will be defined to explain the structure of the heat exchange fin 340. In FIG. 13, a vertical direction is defined as a longitudinal direction of the heat exchange fin 340, and a horizontal direction is defined as a width direction of the heat exchange fin 340.

When the shape of the heat exchange fin 340 is described in more detail with reference to the drawings, the heat exchange fin 340 may be continuously bent in a state in which a portion of a metal thin plate is cut.

The heat exchange fin 340 may be repeatedly bent in the same shape in the width direction. In detail, in the heat exchange fin 340, a front contact part 341 coming into contact with the front plate 320, a rear contact part 342 coming into contact with the rear plate 330, and a fin connection part 343 connecting the front contact part 341 to the rear contact part 342 are repeatedly formed.

That is, as illustrated in FIGS. 14 and 15, the heat exchange fin 340 includes a portion of the fin connection part 343 in the width direction. The portion of the fin connection part 343 may come into contact with an inner wall of the accommodation part 350, i.e., an inner surface of the sink body 310 or an inner surface of the barrier 311.

Also, a lower end of the fin connection part 343 is connected to the rear contact part 342. The rear contact part 342 is bent perpendicularly from the lower end of the fin connection part 343 to come into surface contact with the rear plate 330.

The other fin connection part 343 may be disposed on the extending end of the rear contact part 342. The fin connection part 343 may extend upward up to the front contact part 341. The fin connection part 343 may extend in a direction perpendicular to the rear contact part 342 and the front contact part 341 to connect the front contact part 341 to the rear contact part 342. The rear contact part 342 and the front contact part 341 may be connected to be spaced apart from each other by the fin connection part 343.

The front contact part 341 may be disposed on the upper end of the fin connection part 343. The front contact part 341 is bent perpendicularly from the upper end of the fin connection part 343 to come into surface contact with the front plate 320.

That is, the rear plate 330 and the rear contact part 342 and also the front plate 320 and the front contact part 341 may be disposed in parallel to each other and have surface contact structures. Also, a space through which the refrigerant flows may be defined between the fin connection parts that are adjacent to each other, and the refrigerant within the accommodation part 350 may flow in the longitudinal direction along the heat exchange fin 340.

Thus, the refrigerant flowing inside the accommodation part 350 may be heat-exchanged with the heat exchange fin 340. The heat exchange fin 340 may cool the front plate 320 and the rear plate 330, particularly, uniformly cool the entire surface of the front plate 320 coming into contact with the heat generation surface 130*b* of the thermoelectric module 130.

Also, the rear contact part 342, the fin connection part 343, and the front contact part 341 may be continuously provided, and thus, the same structure may be repeatedly provided in the width direction of the heat exchange fin 340.

The heat exchange fins 340 may extend in the longitudinal direction and thus alternately arranged in the left and right directions repeatedly. Due to the above-described structure, the refrigerant flowing between the fin connection parts 343 may be reduced in flow rate. Thus, sufficient heat-exchange time of the refrigerant coming into direct contact with the heat exchange fin 340 or the front plate 320 and the rear plate 330 may be secured.

In detail, the heat exchange fin 340 may be constituted by a first passage 344 and a second passage 345 continuously extending in the longitudinal direction. The first passage 344 and the second passage 345 may be arranged to cross each other. That is, the second passage 345 may be continuously disposed on a lower end of the first passage 344, and a center of the first passage 344 and a center of the second passage 345 are spaced apart from each other in parallel to each other.

A central line of the first passage 344 may correspond to one end of the second passage 345, and a central line of the second passage 345 may correspond to one end of the first passage 344. Also, the structure may be repeated over the entre section in the longitudinal direction.

Thus, the refrigerant flowing vertically along the heat exchange fin 340 may be branched by a sidewall of the second passage 345 at a point at which the refrigerant passes through the first passage 344 and then divided into the second passages 345 that are adjacent to each other. Also, the refrigerant may be branched by a sidewall of the first passage 344 at a point at which the refrigerant passes through the second passage 345 and then divided into the first passages 344 that are adjacent to each other. While this process is repeated, the refrigerant may be repeatedly branched into the first passages 344 and the second passages 345. Thus, the refrigerant may be uniformly distributed into the entire first and second spaces 351 and 352 by the structure of the heat exchange fin 340 filled into the first and second spaces 351 and 352. Here, the turbulent flow of the refrigerant may be generated, the flow rate of the refrigerant may be reduced, the sufficient time for the heat exchange may be secured, and the refrigerant in the first space 351 and the second space 352 may be uniformly distributed.

Each of the first passage 344 and the second passage 345 may have a plurality of lengths. The first passage 344 may be constituted by a first long-side passage 344*a* and a first short-side passage 344*b*, and the second passage 345 may be constituted by a second long-side passage 345*a* and a second short-side passage 345*b*. The first long-side passage 344*a* and the first short-side passage 344*b* and also the second long-side passage 345*a* and the second short-side passage 345*b* may have length different from each other.

In this embodiment, the heat exchange fin 340 may have a structure in which the first long-side passage 344*a* having the longest length, the second long-side passage 345*a* having the second longest length, the first short-side passage 344 having the shortest length, and the second short-side passage 345 having the third longest length are successively arranged. Also, the first long-side passage 344*a* may be disposed on the lower end of the second long-side passage 345, and then, this structure may be repeated.

That is, the refrigerant passing through the heat exchange fin 340 may vary in length coming into contact with the wall while passing through the first passages and the second passages, which have the different lengths, and thus, the turbulent flow characteristics of the refrigerant change in the direction of increasing Reynolds number. Thus, the refrigerant passing through the heat exchange fin 340 may be reduced in flow rate on the whole. The first passage 344 and the second passage 345 may have various lengths, and also, various structures that are capable of reducing the flow rate of the refrigerant may be possible.

Figure 16:
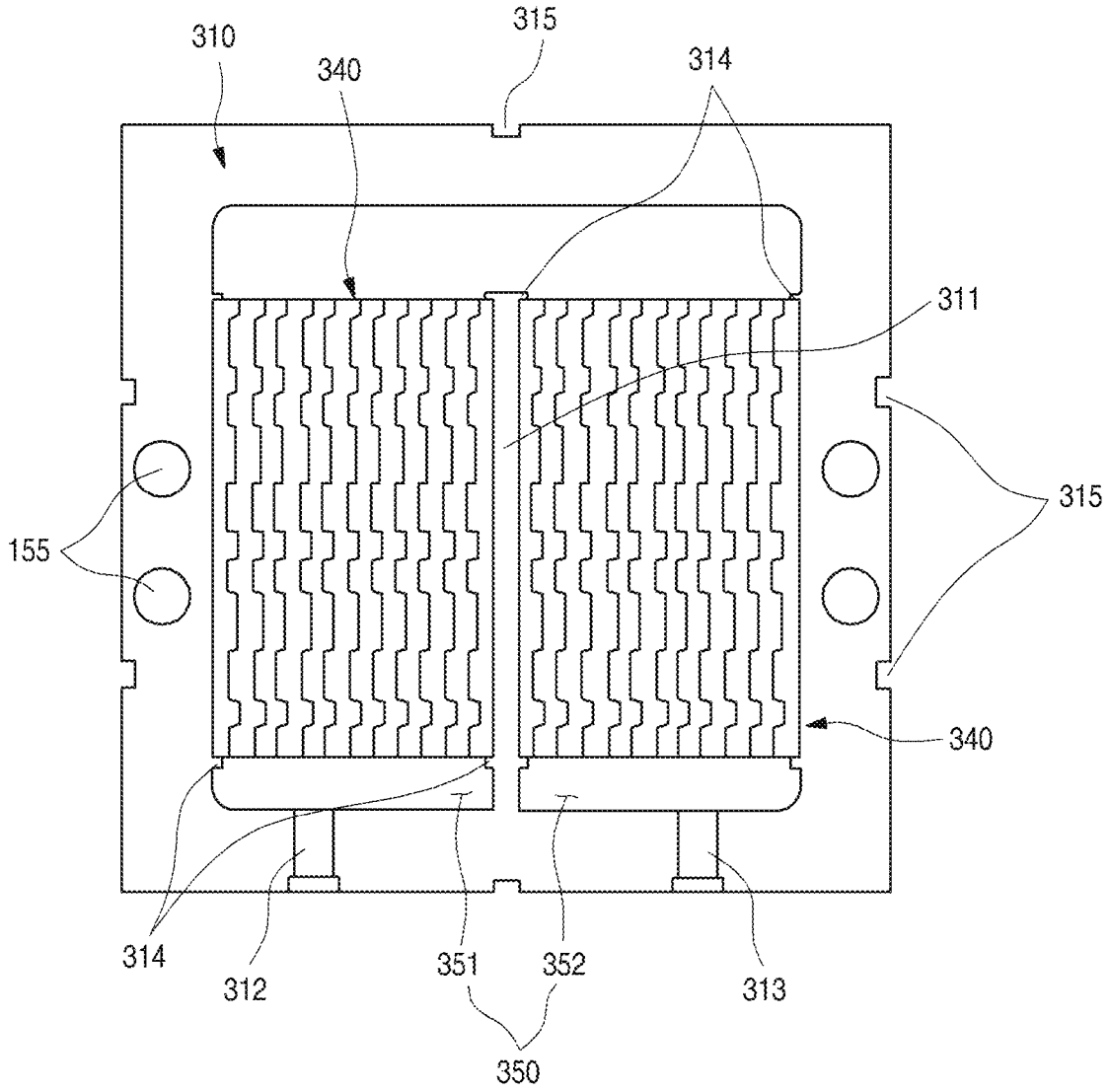
FIG. 16 is a front view illustrating a coupling structure of the heat exchange fin and a sink body.
Figure 17:
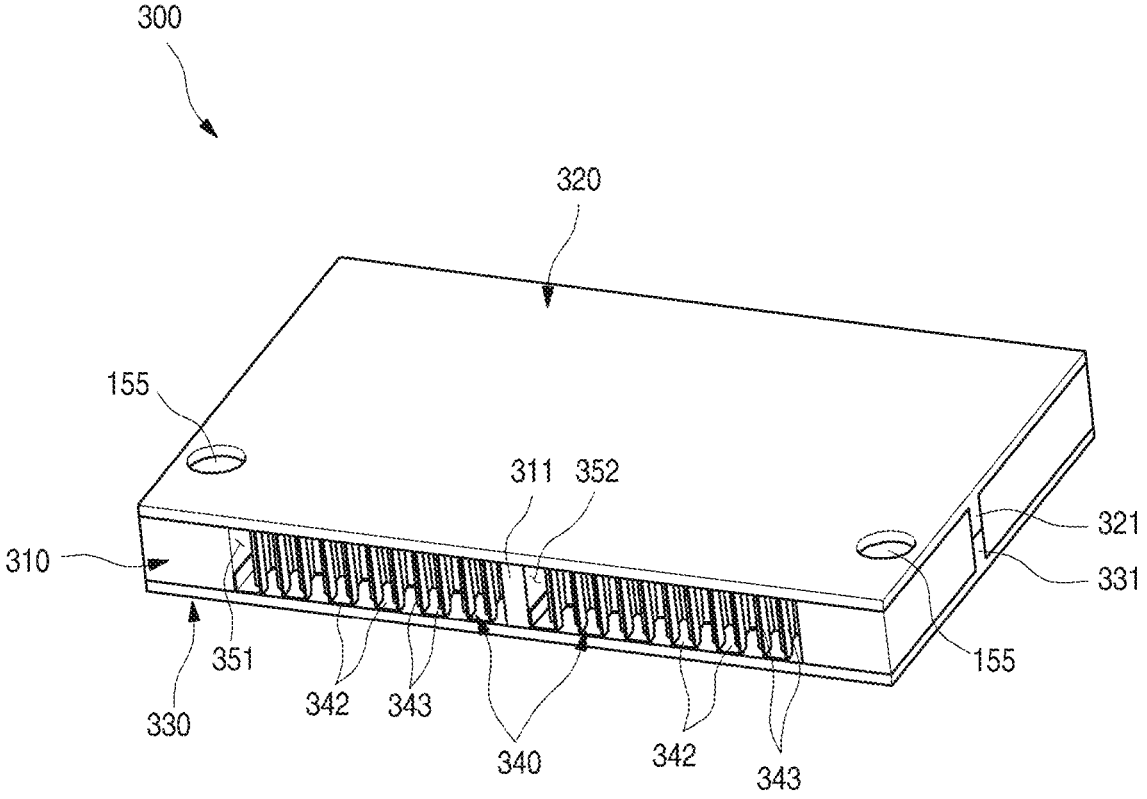
FIG. 17 is a cross-sectional view taken along line D-D' of FIG. 11.
Figure 18:
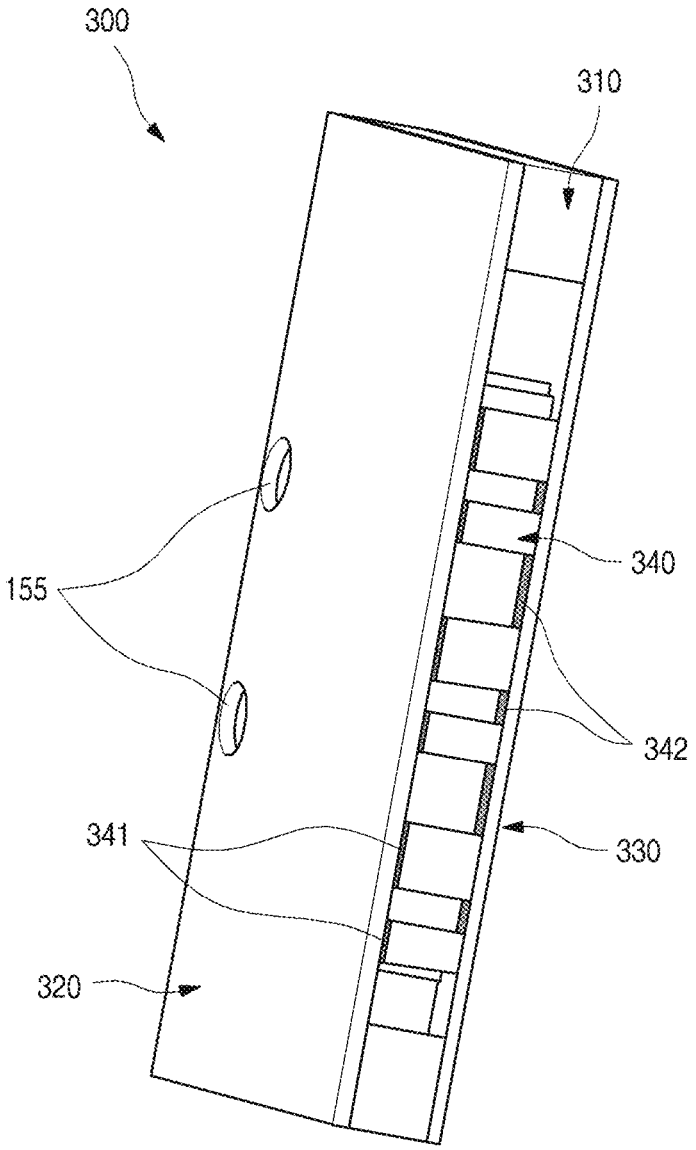
FIG. 18 is a cross-sectional view taken along line E-E' of FIG. 11.

FIG. 16 is a front view illustrating a coupling structure between the heat exchange fin and the sink body. FIG. 17 is a cross-sectional view taken along line D-D' of FIG. 11. FIG. 18 is a cross-sectional view taken along line E-E' of FIG. 11.

As illustrated in the drawings, when the heat sink 300 is completely assembled, the heat exchange fin 340 may be filled into the accommodation part, i.e., the first space 351 and the second space 352. Also, the heat exchange fin 340 may be fixedly mounted to provide a space in the vertical direction by the fin fixing part 314 in the state of being accommodated in the first space 351 and the second space 352.

The upper and lower ends of the heat exchange fin 340 may come into contact with the fin fixing part 314 to restrict movement in the vertical direction. Also, both left and right ends of the heat exchange fin 340 may be restricted in movement in the horizontal direction by coming into contact with the inner surface of the accommodation part 350 and the inner surface of the barrier 311.

That is, in the state in which the heat exchange fin 340 are mounted inside the first space 351 and the second space 352, when the refrigerant flows, the mounted position may be maintained, i.e., the mounted position may be maintained in the firmly fixed state without moving or being shaken.

Also, in the state in which the heat sink 300 is assembled, the front contact part 341 may come into contact with the inner surface of the front plate 320, and the rear contact part 342 may come into contact with the inner surface of the rear plate 330. Thus, the fin connection part 343 may have a length corresponding to a length between the front plate 320 and the rear plate 330.

Due to the above-described structure, the refrigerant passing through the heat exchange fin 340 may come into contact with the surface of the heat exchange fin 340 to decrease in flow rate so that the heat exchange with the heat exchange fin 340 is sufficiently performed. Also, the front contact part 341 and the rear contact part 342 of the heat exchange fin 340 may effectively cool the front plate 320 and the rear plate 330 in the state of coming into surface contact with the front plate 320 and the rear plate 330, thereby realizing uniform cooling performance on the entire surface.

Also, the refrigerant introduced into the first space 351 flows over the entire width direction of the heat exchange fin 340 in the state in which the heat exchange fin 340 is spaced apart from the upper and lower ends of the accommodation part 350, and then, the refrigerant passes through the heat exchanging fin 340 to flow into the second space 352 beyond the barrier 311 and pass through the heat exchange fin 340 disposed in the second space 352.

The mounted state of the front plate 320 and the rear plate 330 has to be firmly maintained. For this, the brazing may be performed on the front plate 320 and the rear plate 330 in the state in which the front plate 320 and the rear plate 330 come into surface contact the circumferences of the front and rear surfaces of the sink body 310.

The refrigerant may sufficiently cool the heat generation surface 130*b* of the thermoelectric module 130 through the direct and indirect cooling of the front plate 320. Also, due to this structure, an additional heat dissipation fin for dissipating heat may be omitted from the heat sink 300. In this case, the heat sink may be compact. Since the heat sink 300 has the compact structure, the structure of the thermoelectric module assembly 100 itself may also be compact to minimize loss in capacity within the refrigerator, i.e., storage capacity of the cryogenic freezing compartment 200.

Also, the front plate 320 and the rear plate 330 may fixedly adhere to the front and rear surfaces of the barrier 311 to more firmly fix the sink body 310. In addition, the fixing boss 114*a* passing through the heat sink 300 may pass through the front plate 320, the rear plate 330, and the sink body 310 to allow the front plate 320 and the rear plate 330 to more firmly fix the sink body 310.

The inside of the heat sink 300, i.e., the accommodation part 350 may be sealed by the front plate 320 and the rear plate 330 to prevent the refrigerant from leaking. When the refrigerant leaks, the refrigeration cycle may abnormally operate to have a major influence on the entire performance of the refrigerator 1. Thus, the coupling state of the front plate 320 and the rear plate 330 has to be maintained.

Figure 19:
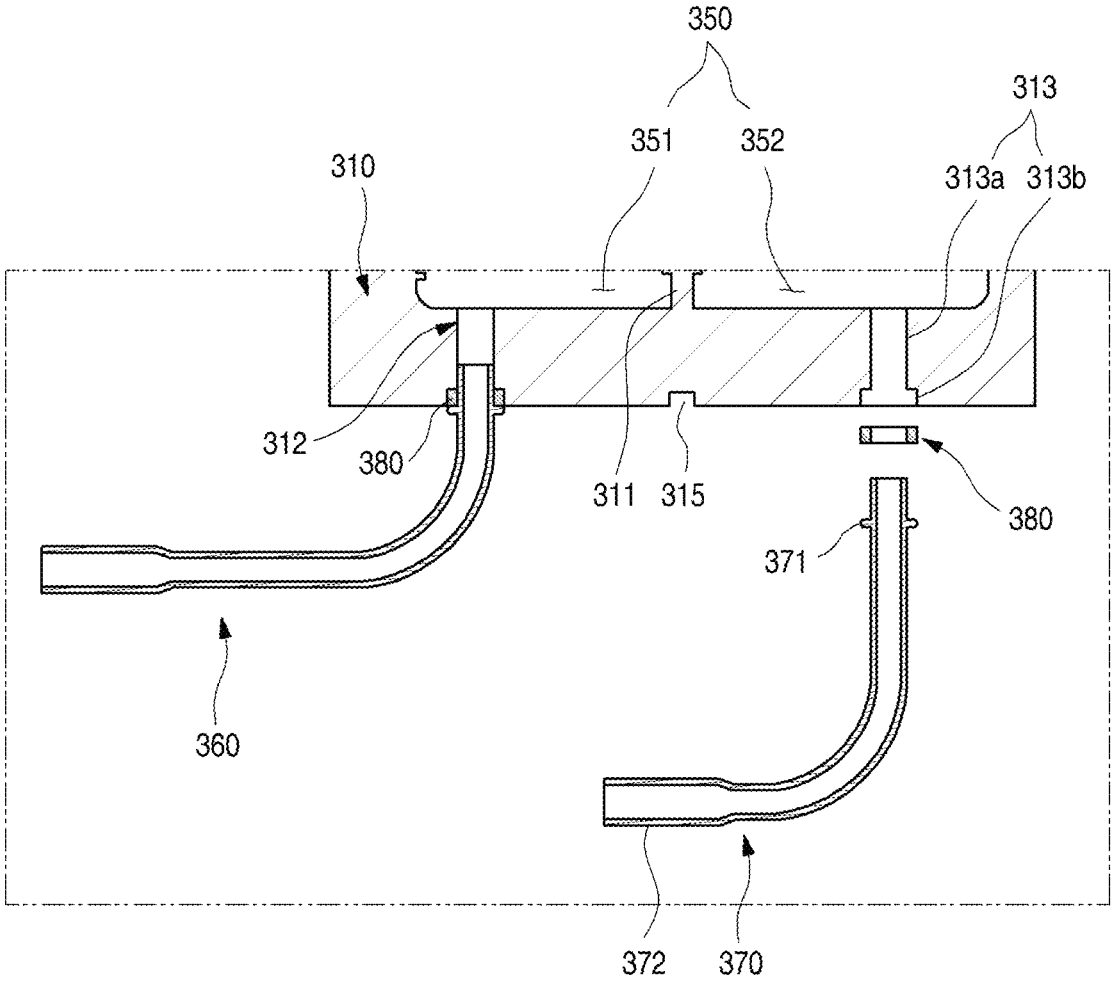
FIG. 19 is a view illustrating a coupling structure of the sink body, a refrigerant inflow tube, and a refrigerant outflow tube.

FIG. 19 is a view illustrating a coupling structure of the sink body, the refrigerant inflow tube, and the refrigerant outflow tube.

As illustrated in the drawing, the refrigerant inflow tube 360 and the refrigerant outflow tube 370 may be connected to the bottom surface of the sink body 310. The refrigerant introduced through the refrigerant inflow tube 360 may be introduced into the first space 351, and the refrigerant within the second space 352 may be discharged through the refrigerant outflow tube 370.

To mount the refrigerant inflow tube 360 and the refrigerant outflow tube 370, the inflow hole 312 and the outflow hole 313 may be defined in the bottom surface of the sink body 310. The inflow hole 312 and the outflow hole 313 may be defined in both left and right sides with respect to the barrier 311. Also, the inflow hole 312 may be defined to pass through the bottom surface of the first space 351, and the outflow hole 313 may be defined to pass through the bottom surface of the second space 352. Here, ends of the refrigerant inflow tube 360 and the refrigerant outflow tube 370 may be inserted into the inflow hole 312 and the outflow hole 313, and thus, the refrigerant inflow tube 360 and the refrigerant outflow tube 370 may be fixed in the state in which the ends are inserted.

The inflow hole 312 and the outflow hole 313 have the same structure except for their positions. Thus, to avoid the duplicated description, the refrigerant outflow tube 370 mounted in the outflow hole 313 will be described in detail as an example.

The outflow hole 313 extends to pass through the lower end of the sink body 310 and includes a passage part 313*a* having a size corresponding to an outer diameter of the refrigerant outflow tube 370 and an inlet part 313*b* having a diameter greater than that of the passage part 313*a*.

The inlet part 313*b* provides an opened inlet of the outflow hole 313 and an opening into which the refrigerant outflow tube 370 is inserted. Also, the inlet part 313*b* has an inner diameter greater than an outer diameter of the refrigerant outflow tube 370, and a welding ring 380 is inserted into the inlet part 313*b*. The welding ring 380 may be penetrated by the refrigerant outflow tube 370 and seated on the inlet part 313*b*. Thus, the welding ring 380 may be melted by bulging processing so that the refrigerant outflow tube 370 is fixedly mounted to the inside of the inlet part 313*b*.

A stopping part 371 coming into contact with the welding ring 380 protrudes from an outer surface of the refrigerant outflow tube 370. An insertion depth of the refrigerant outflow tube 370 may be limited by the stopping part 371, and the refrigerant outflow tube 370 may be inserted by a set depth into the welding ring 380.

The refrigerant outflow tube 370 may have a tube connection part 372 on the other end opposite to the portion inserted into the sink body 310. The tube connection part 372 may have an expanded shape. Thus, a tube connected to the capillary tube 75 or an outlet of the expansion device may be connected to the tube connection part 372 of the refrigerant inflow tube 360. Also, an evaporator input tube 771 may be connected to the tube connection part 372 of the refrigerant outflow tube 370.

Thus, the refrigerant inflow tube 360 and the refrigerant outflow tube 370 are installed in the inflow hole 312 and the outflow hole 313. In the state in which the refrigerant inflow tube 360 and the refrigerant outflow tube 370 are connected to the capillary tube 75 and the evaporator input tube 771, the low-temperature refrigerant flowing into the evaporator 77*a* may flow through the heat sink 300.

Figure 20:
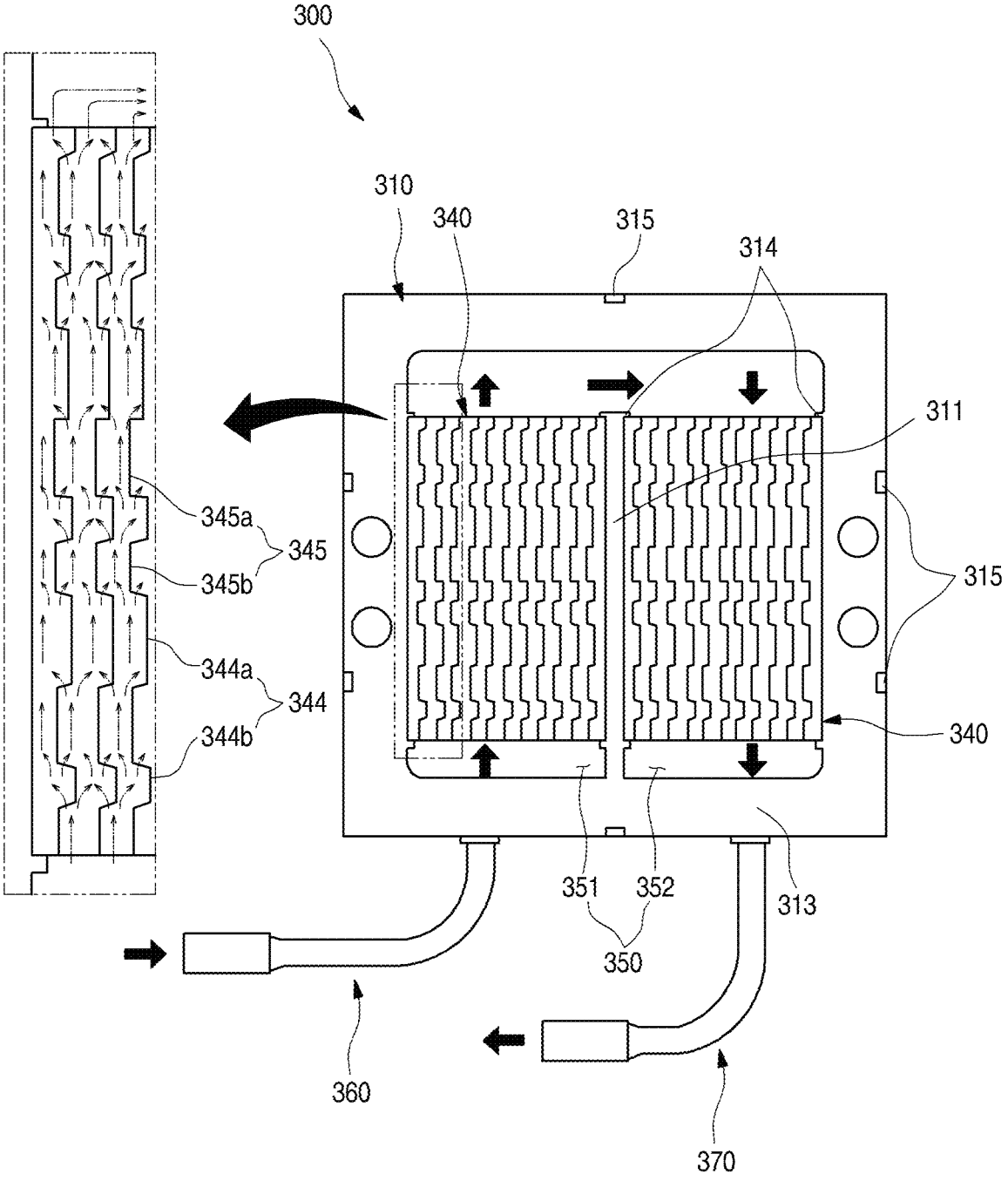
FIG. 20 is a view illustrating a flow of a refrigerant within the heat sink.

FIG. 20 is a view illustrating a flow of the refrigerant within the heat sink.

As illustrated in the drawing, the low-temperature refrigerant passing through the capillary tube 75 or the expansion device is introduced into the heat sink 300 by successively passing through the refrigerant inflow tube 360 and the inflow hole 312. The inflow hole 312 may be defined at a center of the lower end of the first space 351, and the lower end of the heat exchange fin 340 may be spaced apart from the lower end of the inner surface of the sink body 310. Thus, the refrigerant introduced through the inflow hole 312 may uniformly flow upward through the entire area in the width direction of the heat exchange fin 340.

Here, the refrigerant passing through the heat exchange fin 340 may pass to be continuously branched through the first passage 344 and the second passage 345 provided in the heat exchange fin 340 and thus decreases in flow rate due to the turbulence.

The refrigerant within the first space 351 may come into contact with the surface of the heat exchange fin 340 while being reduced in flow rate to realize the sufficient heat exchange with the heat exchange fin 340. The refrigerant may be continuously heat-exchanged in the entire area in the width direction of the heat exchange fin 340 while passing in the longitudinal direction of the heat exchange fin 340.

Also, the refrigerant passing through the heat exchange fins 340 is collected into the space between the upper end of the inner surface of the first space 351 and the upper end of the heat exchange fins 340 to flow into the second space 352 through the space defined by the barrier 311.

The refrigerant introduced into the upper end of the second space 352 passes again through the heat exchange fin 340 accommodated in the second space 352 while flowing downward. Here, the refrigerant flowing downward may pass to be continuously branched through the first passage 344 and the second passage 345 provided in the heat exchange fin 340 and thus decreases in flow rate due to the turbulence. Also, the refrigerant within the second space 352 may come into contact with the surface of the heat exchange fin 340 while being reduced in flow rate to realize the sufficient heat exchange with the heat exchange fin 340.

All the refrigerant passing through the heat exchange fin 340 flows through the space between the lower end of the heat exchange fin 340 and the lower end of the inner surface of the second space 352. Also, the refrigerant may be discharged through the outflow hole 313 defined in the center of the lower end of the second space 352 and the refrigerant outflow tube 370 to flow to the evaporator input tube 771.

While the refrigeration cycle operates, the low-temperature refrigerant may be supplied to the evaporator 77*a* after passing through the heat sink 300. While passing through the heat sink 300, the low-temperature refrigerant may directly cool the front plate 320 and the rear plate 330 and simultaneously indirectly cool the front plate 320 and the rear plate 330 through the heat-exchange with the heat exchange fin 340.

The front plate 320 may be cooled to a low temperature provided by the evaporator 77*a* through the introduction of the refrigerant into the heat sink 300, and the heat generation surface 130*b* of the thermoelectric module 130, which comes into contact with the front plate 320, may also be cooled to a low temperature. Also, when power is applied to the thermoelectric module 130, the heat absorption surface 130*a* of the thermoelectric module 130 may reach an extremely low temperature state that is significantly lowered than the low-temperature state of the heat generation surface 130*b* to cool the inside of the cryogenic freezing compartment 200 to a cryogenic temperature.

That is, the heat absorption surface 130*a* of the thermoelectric module 130 may reach the cryogenic state that is desired in the cryogenic freezing compartment 200 by using a hybrid type manner in which the heat generation surface 130*b* of the thermoelectric module 130 itself is connected to the refrigeration cycle.

Figure 22:
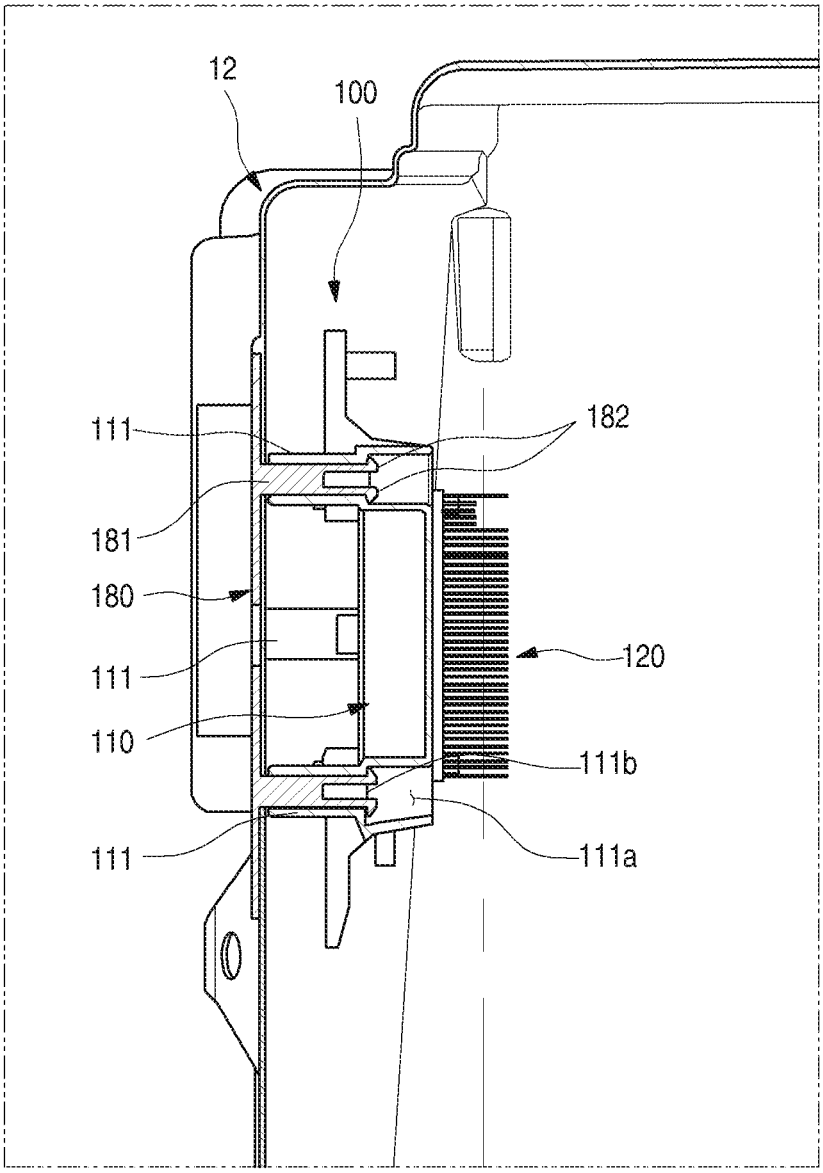
FIG. 22 is a partial cross-sectional view illustrating a coupling structure of the thermoelectric module assembly and the inner case.

FIG. 21 is a partial front view illustrating a state in which the thermoelectric module assembly is mounted on the inner case. FIG. 22 is a partial cross-sectional view illustrating a coupling structure of the thermoelectric module assembly and the inner case.

As illustrated in the drawings, in the thermoelectric module assembly 100, the housing coupling part 117 may be fixedly coupled to the grill fan assembly 50, and the spacer 111 may be coupled to the coupling part and then fixedly coupled to the inner case 12.

The opened front surface of the module housing 110 may be closely attached to the grill fan assembly 50 through the coupling structure to prevent the cold air from leaking. The rear surface of the module housing 110 may be spaced apart from the inner case 12 to secure the workability in connection between the tubes through the refrigerant flows and more improve the heat dissipation performance of the heat sink 300.

In the coupling structure of the spacer 111 and the inner case 12, the spacer 111 may extend to pass through the module housing 110 and the flange 112. Also, the stepped part 111*b* may be disposed inside the hollow 111*a* of the spacer 111.

The stepped part 111*b* may allow the coupling part 181 to be fixedly coupled in the state of being inserted into the hollow 111*a* of the spacer 111 and be hooked with a hook 182 disposed on an end of the coupling part 181.

The coupling part 181 may be made of a separate material and coupled and mounted on the inner case 12. The coupling part 181 may be disposed on a module fixing member 180 mounted on the rear side of the inner case 12.

Since the spacer 111 and the coupling part 181 are coupled to each other, the module housing 110 and the inner case 12 may be spaced an extending length of the spacer 111 from each other so that the connection operation of the tube through which the refrigerant flows is more easily performed.

Figure 23:
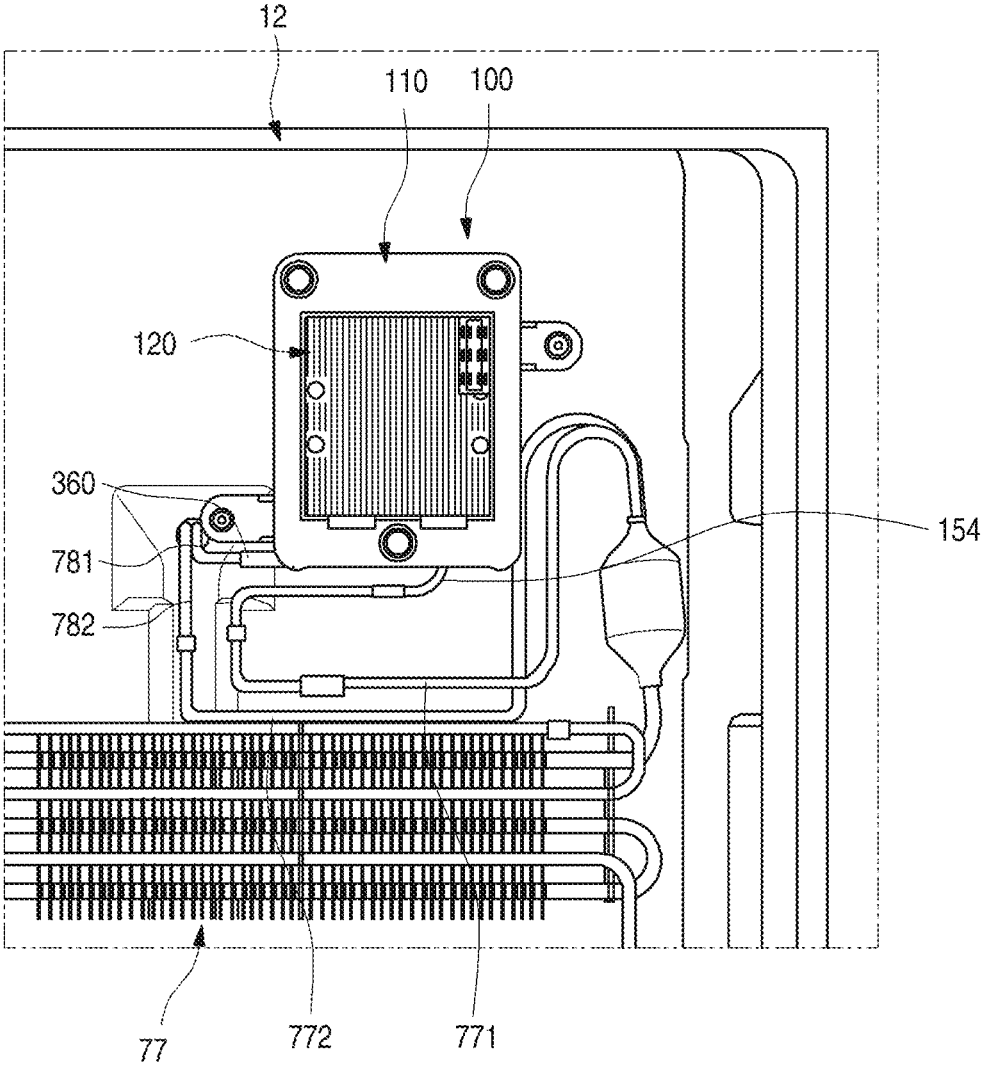
FIG. 23 is a view illustrating a connection state of the thermoelectric module assembly, the evaporator, and a refrigerant tube.
Figure 24:
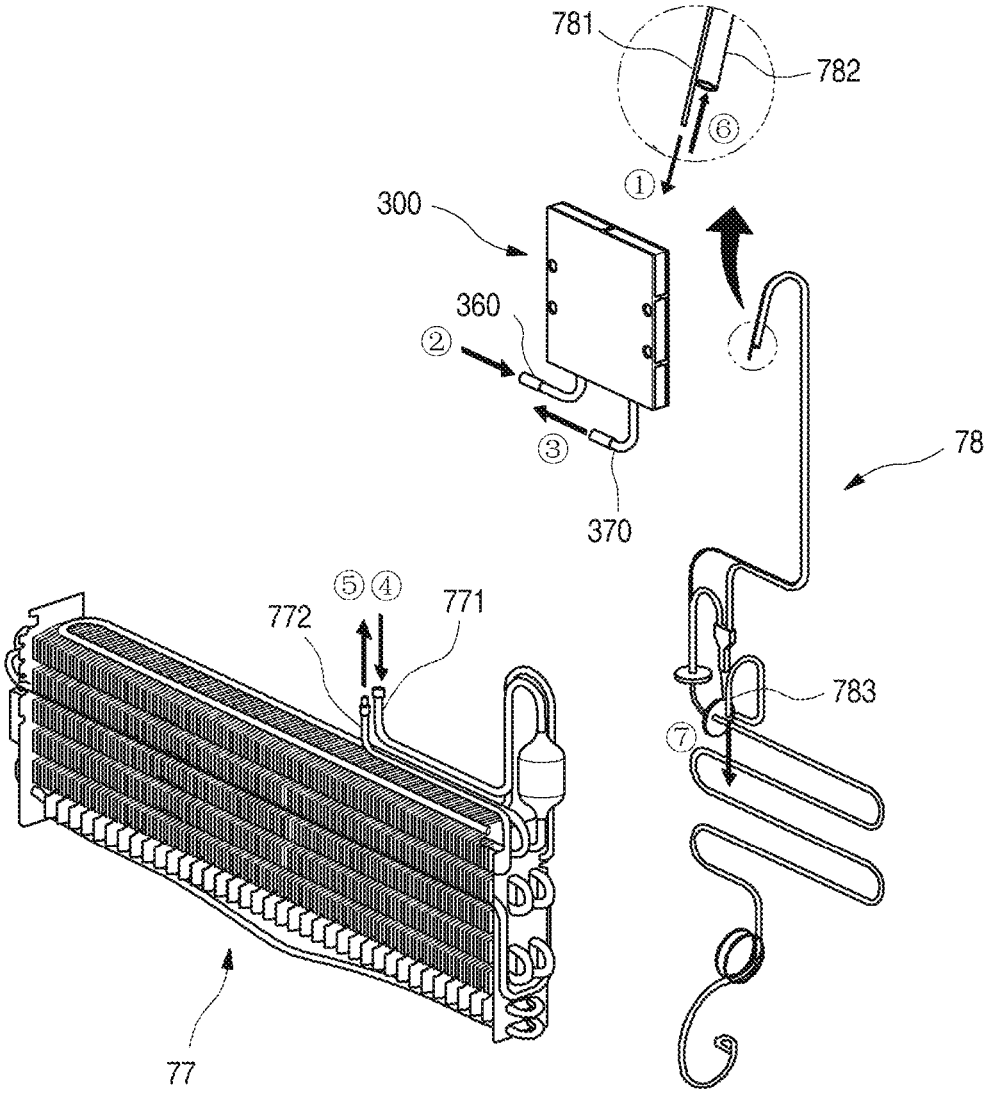
FIG. 24 is a schematic view illustrating a flow path between the thermoelectric module assembly and the evaporator.

FIG. 23 is a view illustrating a connection state of the thermoelectric module assembly, the evaporator, and the refrigerant tube. FIG. 24 is a schematic view illustrating a flow path between the thermoelectric module assembly and the evaporator.

As illustrated in the drawings, the heat sink 300 of the thermoelectric module assembly 100 may be cooled by using the low-temperature refrigerant introduced into the evaporator 88. That is, to cool the heat generation surface 130*b* of the thermoelectric module 130, a portion of the refrigerant tube introduced into the evaporator 77 may be bypassed to be introduced into the heat sink 300.

In detail, the evaporator 77 may be mounted between the inner case 12 and the grill fan assembly 50. Also, the thermoelectric module assembly 100 may be fixedly mounted on the grill fan assembly 50 and the inner case 12 and be disposed above the evaporator 77.

Here, the thermoelectric module assembly 100 may be disposed on one side that is adjacent to the distal tube of the evaporator 77 of both left and right sides of the evaporator 77 so that the evaporator 77 and the tube assembly 78 are easily connected to each other. That is, the evaporator input tube 771 through which the refrigerant is introduced into the evaporator 77 may be disposed adjacent to an end of an evaporator output tube 772.

As described above, the thermoelectric module 130, the evaporator 77, and the tube assemblies 78 may be more easily connected to each other through the disposition structure of the thermoelectric module assembly 100 and the coupling structure of the module housing 110.

Also, the refrigerant inflow tube 360 and the refrigerant outflow tube 370 may be bent to the evaporator input tube 771 and the evaporator output tube 772 so that the evaporator input tube 771 and the evaporator output tube 772 of the evaporator 77 are easily connected to each other.

The tube assembly 78 may be disposed outside the inner case 12, i.e., on a rear wall of the refrigerator main body 10. The tube assembly 78 includes a compressor connection part 783 connected to the compressor 71, a capillary tube 781 connected to the evaporator input tube 771, and an output connection part 782 connected to the evaporator output tube 772. The tube assembly of FIG. 24 has a tube structure in which the evaporators independently provided in the freezing compartment and the refrigerating compartment are connected to each other. Here, the number of evaporators and the connection structure of the evaporators may be changed. Also, a portion of the connection structure of the compressor and the condenser 73 may be omitted on one side of the tube assembly 78.

As illustrated in FIG. 23, in the state in which the thermoelectric module assembly 100 and the evaporator 77 are mounted on the inner case 12, a process of welding the tubes through which the refrigerant flows is performed. The welding process may be performed in the space between the thermoelectric module assembly 100 and the evaporator 77. Here, the space for easily performing the welding process may be secured by the spaced arrangement of the module housing 110 and the arrangement of the thermoelectric module assembly 100 and the evaporator 77.

In the state in which the evaporator 77 and the thermoelectric module assembly 100 are fixedly mounted, the refrigerant inflow tube 360 of the thermoelectric module assembly 100 may be connected to the capillary tube 781 through the welding, and the refrigerant outflow tube 370 may be connected to the evaporator input tube 771 through the welding. Also, the evaporator output tube 772 may be connected to the output connection part 782 of the tube assembly 78 through the welding.

In the flow path of the refrigerant according to the connection structure of the tubes, the low-temperature refrigerant introduced through the capillary tube 781 may pass through the heat sink 300 to cool the heat generation surface 130*b* of the thermoelectric module 130 coming into contact with the heat sink 300. Also, the refrigerant heat-exchanged by passing through the evaporator 77 through the evaporator input tube 771 may be introduced into the tube assembly 78 through the evaporator output tube 772 and the output connection part 782 and then be supplied to the compressor 71 along the compressor connection part 783 of the tube assembly 78. That is, the flow path of the refrigerant may flow in order of ① to ⑦ of FIG. 24.

As described above, the heat sink 300 may be effectively cooled by bypassing the low-temperature refrigerant introduced into the evaporator 77. The refrigerant flowing through the inside of the heat sink 300 may be reduced in flow rate because the refrigerant flows in the turbulence state by the heat exchange fin 340, and thus, may be effectively heat-exchanged with the heat exchange fin 340 that increases in surface area for the heat exchange. Also, the heat exchange fin 340 may uniformly cool the entire area of the front plate 320 in the state of coming into contact with the front plate 320. Thus, the heat generation surface 130*b* of the thermoelectric module 130 coming into contact with the front plate 320 may be cooled.

The heat absorption surface 130*a* of the thermoelectric module 130 may be in the extremely low-temperature state through the cooling of the heat generation surface 130*b* by the heat sink 300, Here, a temperature difference between the heat absorption surface 130*a* and the heat generation surface 130*b* may be about 30° C. or more so that the inside of the cryogenic freezing compartment 200 is cooled to an extremely low temperature of about −40° C. to about −50° C.

Hereinafter, a state and an operation state of the thermoelectric module assembly 100 capable of realizing such an extremely low temperature will be described with reference to the drawings.

Figure 25:
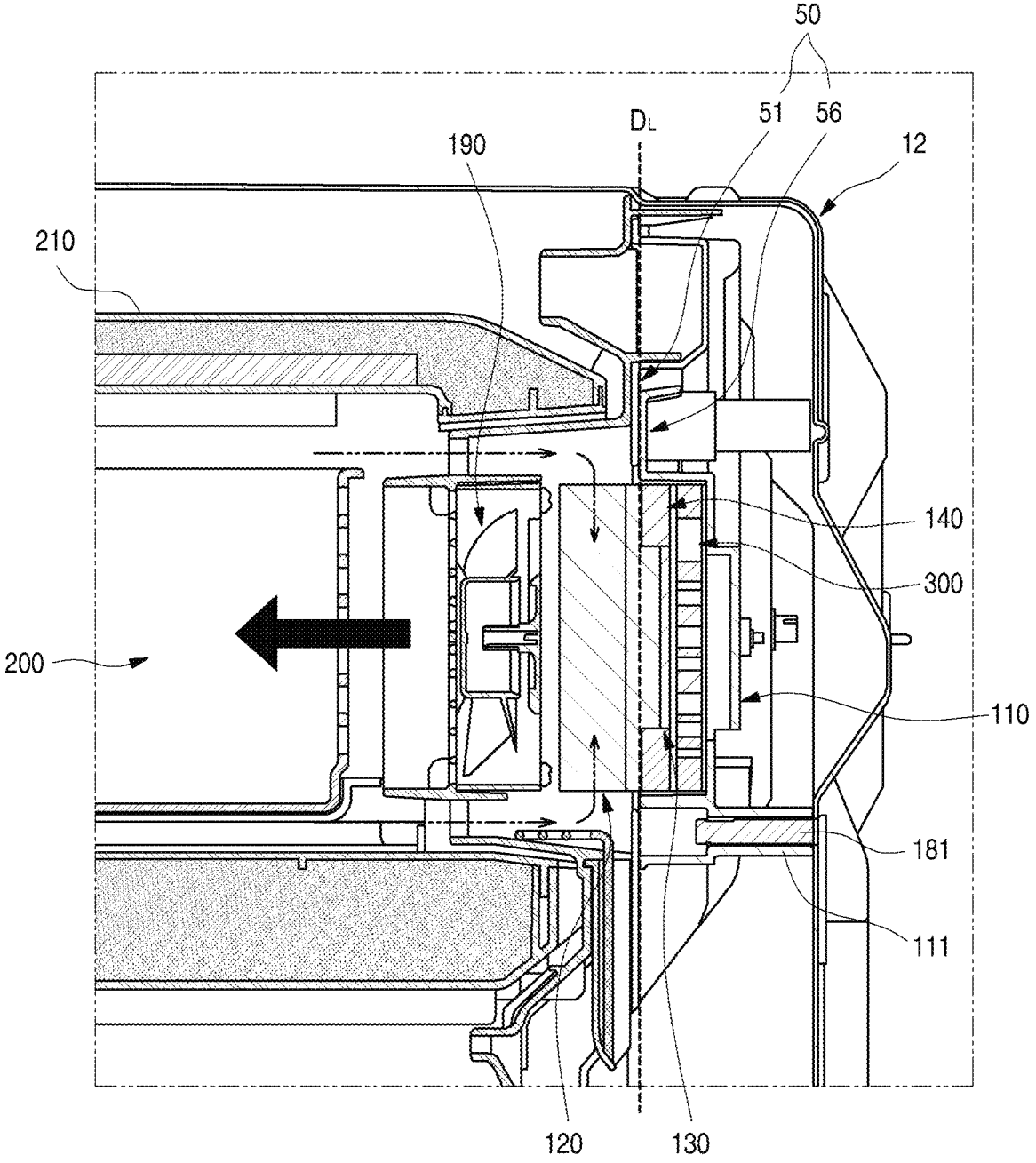
FIG. 25 is a view illustrating a state in which cold air is supplied while the thermoelectric module assembly operates.

FIG. 25 is a view illustrating a state in which cold air is supplied while the thermoelectric module assembly operates.

As illustrated in the drawing, a cryogenic case 210 providing the cryogenic freezing compartment 200 is mounted inside the refrigerating compartment 30. The opened rear surface of the cryogenic case 210 is closely attached to the grill fan 51. Also, the thermoelectric module accommodation part 53 on which the thermoelectric module assembly 100 and the cooling fan 190 are mounted may be inserted through the opened rear surface of the cryogenic case 210 to supply cold air into the cryogenic freezing compartment 200.

The thermoelectric module assembly 100 may be disposed at the rear side of the cooling fan 190 and fixedly mounted on the grill fan assembly 50 and the inner case 12 in the state of being accommodated into and assembled with the inside of the module housing 110.

Here, a portion, at which the cold air is generated, of the thermoelectric module assembly 100 may be disposed inside the cryogenic freezing compartment 200, and a portion, at which heat is generated, of the thermoelectric module assembly 100 may be disposed inside the space in which the evaporator 77 is accommodated.

In FIG. 25, the arrangement of the thermoelectric module assembly will be described in more detail with reference to an extension line DL of the front surface of the shroud 56 that is the boundary between the cryogenic freezing compartment 200 and the accommodation space of the evaporator 77.

The heat absorption side of the thermoelectric module assembly 100 may be disposed at the front, and the heat dissipation side may be disposed at the rear with respect to the extension line DL. Here, the extension line DL may be the boundary between the refrigerating compartment and the space in which the evaporator 77 is accommodated and be defined as the rear surface of the grill fan 51, but not the front surface of the shroud 56.

That is, in the thermoelectric module assembly 100 is mounted, the cold sink 120 may be disposed at a front side of the extension line DL, and the rear surface of the cold sink 120 may be disposed on the extension line DL.

Thus, as illustrated in FIG. 25, the whole cold sink 120 from which the cold air is generated may be disposed inside the cryogenic freezing compartment 200, i.e., inside the thermoelectric module accommodation part 53. Thus, the cold sink 120 may be disposed in an independent space with respect to the heat sink 300 to completely supply the cold air generated from the cold sink 120 into the cryogenic freezing compartment 200. Here, when the cold sink 120 is disposed further backward, a portion of the cold sink 120 may be output of the area of the cryogenic freezing compartment 200 to deteriorate the cooling performance. Also, when the cold sink 120 is disposed further forward, the cryogenic freezing compartment 200 may be reduced in volume.

All the heat sink 300, the insulation material 140, and the thermoelectric module 130 may be disposed at the rear side with respect to the extension line DL, and the front surface of the insulation material 140 coming into contact with the rear surface of the cold sink 120 may be disposed on the extension line DL. The insulation material 140 may substantially cover an opening in the extension line DL to completely block the heat transfer between the cold sink 120 and the heat sink 300.

Also, the heat sink 300 is disposed on a region in which the evaporator 77 is accommodated, i.e., a region between the grill fan assembly 50 and the inner case 12, and the refrigerant supplied to the evaporator 77 cools the heat sink 300. The cooling performance of the thermoelectric module 130 may be maximized through the cooling of the heat sink 300 using the low-temperature refrigerant. The heat sink 300 may be additionally cooled using the cold air of the evaporator 77 by the module housing 110 spaced apart from the inner case 12.

As described above, the thermoelectric module assembly 100 may dissipate heat in the region in which the evaporator 77 is disposed and absorb heat in the cryogenic freezing compartment 200 to cool the cryogenic freezing compartment 200 to the extremely low-temperature state.

In addition to the foregoing embodiment, a refrigerator according to various embodiments may be exemplified.

Other embodiments differ only in the configuration of the heat sink, but the other configurations are the same. Particularly, since only the configuration of the sink body constituting the heat sink is different, only the differences will be described in detail, and the same reference numerals are used and detailed descriptions or illustration thereof may be omitted.

Figure 26:
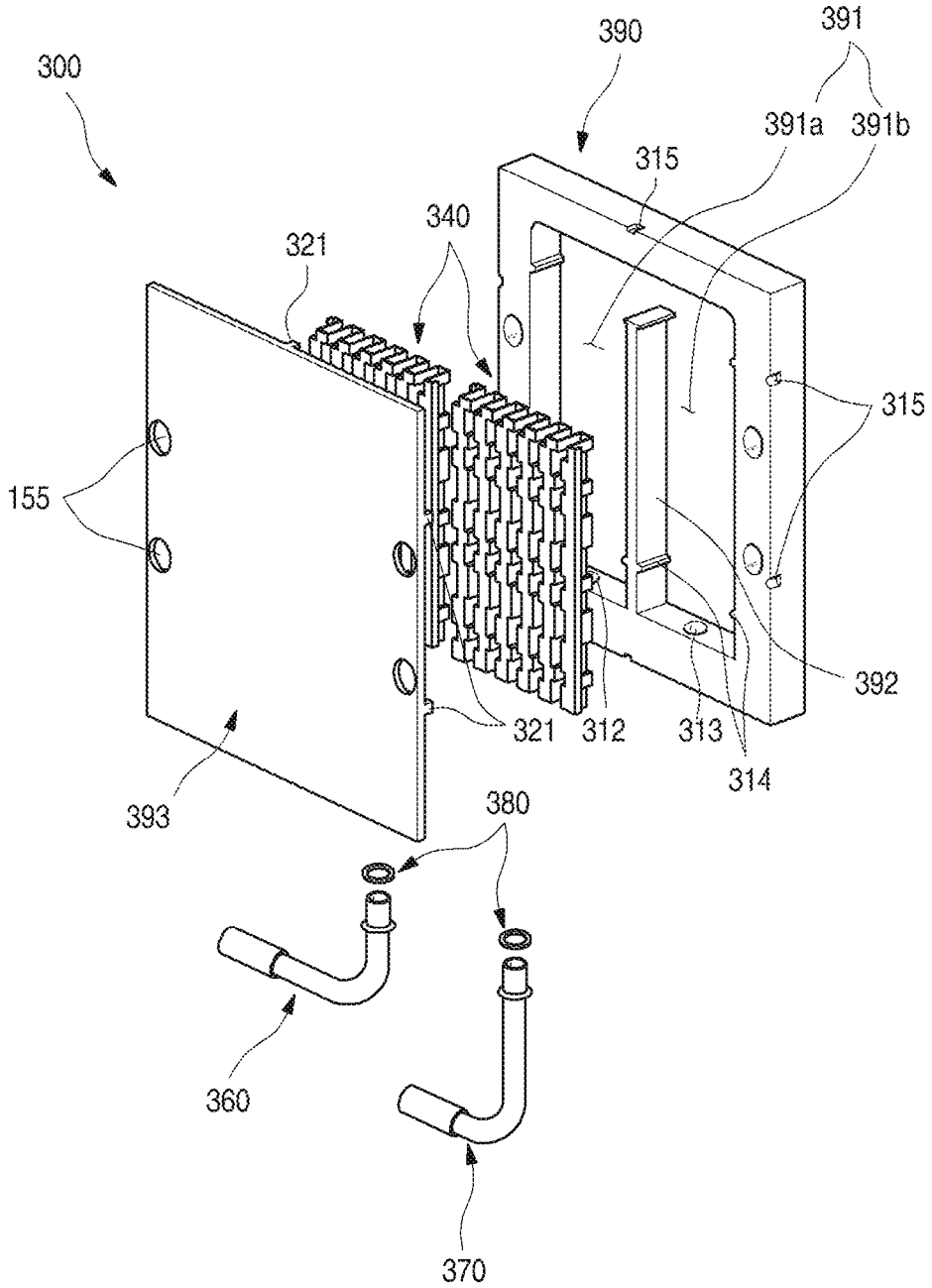
FIG. 26 is an exploded perspective view illustrating a structure of a heat sink according to another embodiment.

FIG. 26 is an exploded perspective view illustrating a structure of a heat sink according to another embodiment.

As illustrated in the drawing, a heat sink 300 according to another embodiment may be defined in outer appearance by a sink body 390 defining an accommodation part 350 in which a heat exchange fin 340 is accommodated and a cover plate 393 covering an opened front surface of the sink body 390.

The sink body 310 may be made of a metal material such as aluminum and have a corresponding shape to be inserted into an accommodation groove 114 of a module housing 110. The sink body 390 may have a rectangular cross-section. Also, the sink body 390 may have a front surface that is opened to the thermoelectric module 130 to define an accommodation part 391 that is recessed into the sink body 390. The recessed shape of the accommodation part 391 may be formed through processing such as milling.

The accommodation part 391 may have a structure that is partitioned by a barrier 392 and be recessed by a height of the heat exchange fin 340. The accommodation part 350 may have a first space part 391*a* and a second space part 391*b*, which are defined in both left and right sides with respect to the barrier 392. The first space part 391*a* and the second space part 391*b* may communicate with each other through an upper side of the barrier 392. Also, an inflow hole 312 and an outflow hole 313 into which a refrigerant inflow tube 360 and a refrigerant outflow tube 370 are inserted and mounted may be defined in lower ends of the first and second space parts 391*a* and 391*b*, respectively.

A fin fixing part 314 may be defined in the accommodation part 391 so that the heat exchange fin 340 is fixed in position. The fin fixing part 314 may be disposed on left and right sides of an inner surface of the accommodation part 391 and both surfaces of the barrier 392 to restrict upper and lower ends of the heat exchange fin 340.

The heat exchange fin 340 may have the same configuration as that according to the foregoing embodiment and come into contact with a cover plate 393 in the state of being mounted on the accommodation part 391. The cover plate 393 may have the same structure as the front plate 320 according to the foregoing embodiment.

The cover plate 393 may have a plate shape corresponding to that of a front surface of the sink body 390 to cover the accommodation part 391. Also, a circumference of the cover plate 393 may come into surface contact with a circumference of the sink body 390 and be bonded through brazing to completely seal the inside of the accommodation part 391.

Also, a restriction piece 321 may be disposed on the circumference of the cover plate 393 and inserted into a restriction groove 315 defined in a position corresponding to the circumference of the sink body 390 to fix the cover plate 393.

Also, a through-hole 155 into which a fixing boss 114*a* is inserted may be defined in each of both sides of the cover plate 393 and the sink body 310. Thus, the cover plate 393 and the sink body 310 may be further fixed to each other by the coupling of the fixing boss 114*a*.

In addition to the foregoing embodiment, a refrigerator according to various embodiments may be exemplified.

In further another embodiment, only the configuration of the thermoelectric module assembly is different, but the other components are the same, and the same reference numerals are used for the same components, and detailed description or illustration thereof may be omitted.

Figure 27:
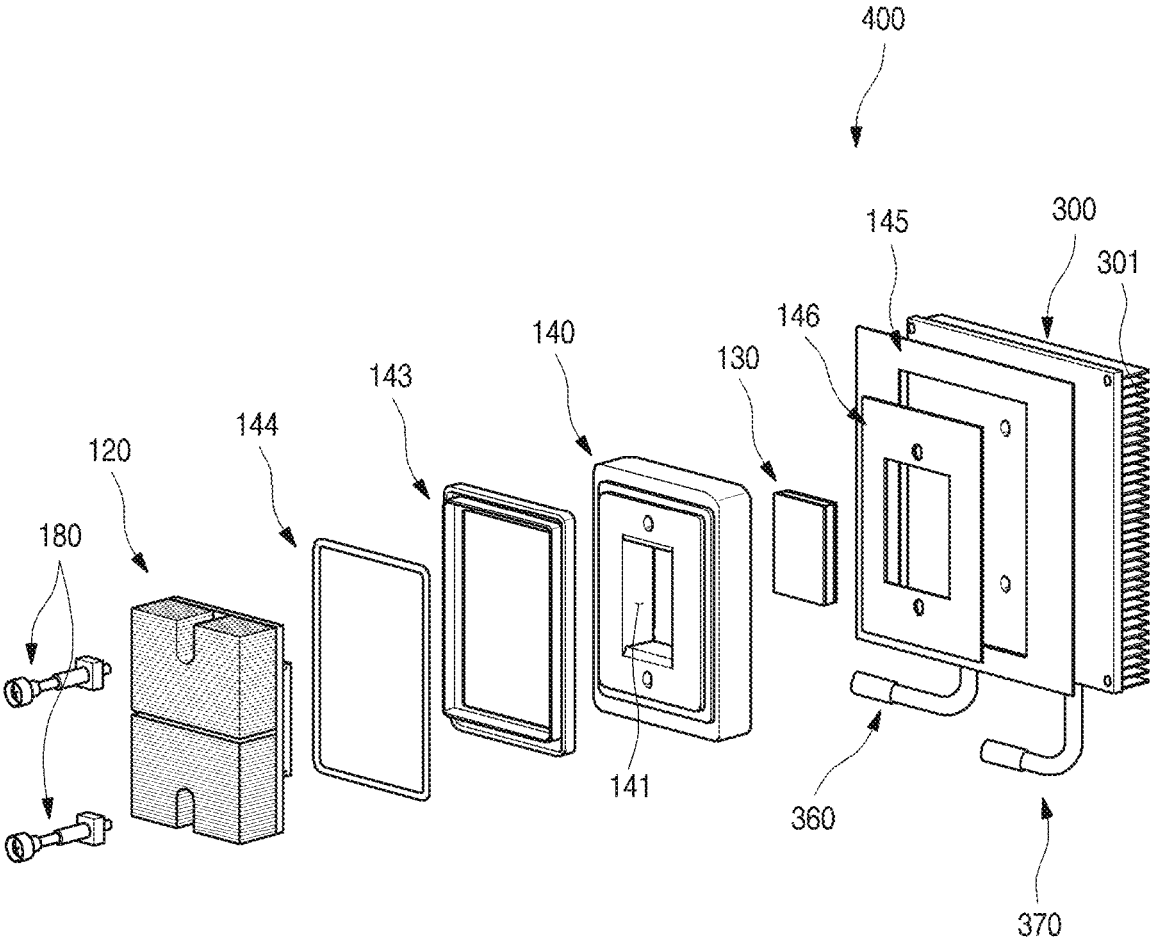
FIG. 27 is an exploded perspective view illustrating a structure of a thermoelectric module assembly according to another embodiment.

FIG. 27 is an exploded perspective view illustrating a structure of a thermoelectric module assembly according to another embodiment.

As illustrated in the drawings, a thermoelectric module assembly 400 according to further another embodiment may be mounted inside the above-described module housing 110. If necessary, the thermoelectric module assembly 400 may be fixedly mounted by a separate constituent without being accommodated in a module housing 110.

The thermoelectric module assembly 400 may include a cold sink 120, a thermoelectric module 130, an insulation material 140, and a heat sink 300.

The cold sink 120 is disposed to face a cryogenic freezing compartment 200 to come into contact with a heat absorption surface 130*a* of the thermoelectric module 130. Thus, cold air generated from the heat absorption surface 130*a* of the thermoelectric module 130 may be supplied into the cryogenic freezing compartment 200 through the cold sink 120. The overall structure and shape of the cold sink 120 may be the same as that according to the foregoing embodiment except for a coupling position of a fixing member 180.

The thermoelectric module 130 may be accommodated in a thermoelectric module accommodation hole 121 defined in the insulation material 140, and the insulation material 140 may be disposed between the cold sink 120 and the heat sink 300. Thus, the cold sink 120 and the heat sink 300 may be completely insulated from each other by the insulation material 140.

Also, a seating member 143 for seating the cold sink 120 may be disposed on a front surface of the insulation material 140. The seating member 143 may be injection-molded by using a plastic material and have a structure that is coupled to a seating groove defined in the front surface of the insulation material 140. Also, the seating member 143 may have an uneven shape to match the rear surface of the cold sink 120. Thus, the cold sink 120 and the insulation material 140 may be stably coupled to each other through the seating member 143.

A sealer 144 may be disposed on a front surface of the seating member 143. The sealer 144 may seal a space between the seating member 143 and the cold sink 120 and be made of a silicon material. Thus, leakage of cold air, which may occur between the heat absorption surface 130*a* and the cold sink 120 of the thermoelectric module 130 may be prevented, and also leakage of cold air to other positions may be prevented.

Also, thermal grease may be applied to the heat generation surface 130*b* and the heat absorption surface 130*a* of the thermoelectric module 130. The heat generation surface 130*b* and the heat absorption surface 130*a* may be effectively conducted to the cold sink 120 and the heat sink by applying the thermal grease.

A refrigerator insulation member 145 may be further disposed on the front surface of the heat sink 300. The refrigerator insulation member 145 may be disposed on the front surface of the heat sink 300 to prevent heat exchange with one side of a space of the freezing compartment 40, which comes into contact with the heat sink 300, from occurring, thereby preventing the heat sink 300 from having an influence on a temperature of one side of the freezing compartment 40 or the inner space of the refrigerator.

Also, a gasket sheet 146 for preventing cold air from leaking may be further disposed between the insulation material 140 and the heat sink 300.

A refrigerant inflow tube 360 and a refrigerant outflow tube 370 may be connected to the heat sink 300 so that the low-temperature cold air introduced into the evaporator 77*a* passes. The heat sink 300 may have the same inner structure as that according to the foregoing embodiment. A flow rate of the refrigerant may be reduced by the heat exchange fin 340 accommodated in the heat sink 300, and heat may be uniformly transferred to an outer surface of the heat sink 300 coming into contact with the heat generation surface 130*b*.

A heat dissipation fin 301 may be further disposed on the rear surface of the heat sink 300. The heat dissipation fin 301 may be provided in a plurality of plate shapes, and the plurality of heat dissipation fins 301 may be spaced a predetermined distance from each other. The heat sink 300 may further improve the cooling effect by the cold air generated in the evaporator 77*a* by the heat dissipation fin 301 to more cool the heat generation surface 130*b* of the thermoelectric module 130.

According to the embodiments, the low-temperature refrigerant supplied to the evaporator may pass through the heat sink of the thermoelectric module assembly for cooling the cryogenic freezing compartment to increase in temperature difference between the heat absorption surface and the heat generation surface of the thermoelectric module, and thus, the cryogenic freezing compartment may realize the extremely low temperature of about −40° C. to about −50° C.

Also, the thermoelectric module, the heat sink, the cold sink, and the insulation material constituting the thermoelectric module assembly may be fixedly mounted on the grill fan assembly in the state of being mounted on the module housing to improve assembility and mounting property.

Particularly, the module housing may be fixedly mounted on the grill fan and also fixedly mounted on in the state of being spaced apart from the inner case to secure the space for the heat dissipation of the heat sink. Also, the space for performing the welding operation for connecting the heat sink to the refrigerant tube may be secured without the space loss in the storage space of the refrigerator and the cryogenic freezing compartment to more improve the workability and productivity.

Also, the heat exchange fin may be provided in the refrigerant flow space within the heat sink to reduce a flow rate of the refrigerant by the heat exchange fin, thereby securing the sufficient time and improving the heat exchange efficiency.

Also, the heat exchange fin may uniformly cool the entire surface coming into contact with the thermoelectric module so that the cooling using the refrigerant and the additional cooling using the heat exchange fin are performed to improve the heat generation-side cooling performance of the thermoelectric module.

Particularly, the heat exchange fin may be configured to reduce the flow rate of the refrigerant due to the generation of the turbulence and increase the surface area coming into contact with the refrigerant. Thus, the cooling performance of the heat generation surface may be more improved.

Also, the coupling structure of the sink body, the front plate, and the rear plate may be firmly maintained, and also, the coupling structure which prevents the front plate form being deformed and maintains the planar surface may be provided to more effectively perform the heat exchange due to the contact with the heat generation surface.

Also, the structures of the sink body, the front plate, and the rear plate may be simplified and easily molded to improve the productivity and reduce the manufacturing costs.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body defining a storage space;

a cryogenic compartment defining an insulation space configured to maintain a compartment temperature independent of a temperature in the storage space;

an evaporator located inside of the storage space and configured to cool the storage space; and a thermoelectric device assembly located at the cryogenic compartment and configured to cool the cryogenic compartment to the compartment temperature that is less than the temperature of the storage space, wherein the thermoelectric device assembly comprises:

a thermoelectric device comprising a heat absorption surface and a heat generation surface, a cold sink located in the cryogenic compartment and configured to contact the heat absorption surface of the thermoelectric device, and a heat sink that contacts the heat generation surface of the thermoelectric device and that is configured to be cooled by refrigerant supplied to the evaporator, wherein the heat sink comprises:

a sink body the defines an accommodation space configured to receive refrigerant therein, a cover plate that covers at least a portion of the accommodation space and that contacts the heat generation surface, and a heat exchange fin located inside of the accommodation space and configured to guide flow of refrigerant in the sink body, wherein the accommodation space comprises a recess that is recessed relative to a front surface of the sink body and that defines a front open surface of the accommodation space, and wherein the cover plate covers the front open surface of the accommodation space.

2. The refrigerator according to claim 1, wherein the accommodation space extends through the sink body from a front open surface of the accommodation space to a rear open surface of the accommodation space, and wherein the cover plate comprises:

a front plate that covers the front open surface of the accommodation space and that contacts the heat generation surface, and a rear plate that covers the rear open surface of the accommodation space.

3. The refrigerator according to claim 1, wherein the cover plate comprises a restriction protrusion that is located at an outer end of the cover plate and that is bent toward the sink body, and wherein the sink body comprises a restriction groove that is defined at a circumference of the sink body and that is configured to receive the restriction protrusion based on the cover plate coupling to the sink body.

4. The refrigerator according to claim 1, wherein the heat sink further comprises a barrier that is disposed in the accommodation space and that partitions the accommodation space into a first space to which refrigerant is introduced and a second space from which refrigerant is discharged, and wherein the heat exchange fin is located in the first space and the second space.

5. The refrigerator according to claim 4, wherein the heat sink further comprises a fin fixing part that protrudes from at least one of the barrier or an inner surface of the accommodation space, the fin fixing part being configured to fix the heat exchange fin at a position that is spaced apart from the inner surface of the accommodation space.

6. The refrigerator according to claim 4, wherein the heat sink further comprises a plurality of fin fixing parts that protrude from the barrier toward the first space and the second space, respectively.

7. The refrigerator according to claim 1, wherein the heat exchange fin has a plate shape that includes a plurality of bent portions, the heat exchange fin defining a passage configured to guide the flow of refrigerant.

8. The refrigerator according to claim 1, wherein the heat exchange fin comprises:

a plurality of contact parts that are in surface contact with the cover plate and that are configured to exchange heat with the cover plate; and a fin connection part that is bent from an end of each of the plurality of contact parts and that connects the plurality of contact parts to one another, and wherein the plurality of contact parts and the fin connection part are arranged in a width direction of the heat exchange fin.

9. The refrigerator according to claim 8, wherein the accommodation space extends through the sink body from a front open surface of the accommodation space to a rear open surface of the accommodation space, wherein the cover plate comprises:

a front plate that covers the front open surface of the accommodation space and that contacts the heat generation surface, and a rear plate that covers the rear open surface of the accommodation space, and wherein the plurality of contact parts comprise:

a front contact part that is in surface contact with the front plate, and a rear contact part that is in surface contact with the rear plate.

10. The refrigerator according to claim 8, wherein the heat sink further comprises a barrier that is disposed in the accommodation space and that partitions the accommodation space into a first space to which refrigerant is introduced and a second space from which refrigerant is discharged, and wherein the heat exchange fin is located in the first space and the second space.

11. The refrigerator according to claim 10, wherein the barrier is located between the first space and the second space and extends in a longitudinal direction transverse to the width direction of the heat exchange fin.

12. The refrigerator according to claim 11, wherein the heat sink further comprises a plurality of fin fixing parts that protrude from the barrier and an inner surface of the accommodation space, the plurality of fin fixing parts being configured to fix the heat exchange fin in each of the first space and the second space.

13. The refrigerator according to claim 11, wherein the sink body defines an inflow hole configured to supply refrigerant into the first space and an outflow hole configured to discharge the refrigerant from the second space, and wherein the inflow hole and the outflow hole are defined at a bottom surface of the sink body that faces the accommodation space.

14. The refrigerator according to claim 11, wherein the heat exchange fin is disposed between a top surface of the accommodation space and a bottom surface of the accommodation space, and wherein the heat exchange fin is spaced apart from each of the top surface and the bottom surface of the accommodation space.

15. The refrigerator according to claim 14, wherein a length of the heat exchange fin in the longitudinal direction is less than a length of the accommodation space in the longitudinal direction.

16. The refrigerator according to claim 7, wherein the heat exchange fin comprises:

a first passage that extends in a longitudinal direction of the heat exchange fin and that is configured to guide the flow of refrigerant in the longitudinal direction; and a second passage that is offset from the first passage in a width direction transverse to the longitudinal direction, that overlaps with at least a portion of the first passage, and is configured to guide the flow of refrigerant branched from the first passage, and wherein the first passage and the second passage are arranged in the longitudinal direction of the heat exchange fin.

17. The refrigerator according to claim 16, wherein the first passage includes a plurality of first passages arranged in the longitudinal direction, wherein the second passage includes a plurality of second passages that are alternately arranged with the plurality of first passages along the longitudinal direction, and wherein lengths of the plurality of first passages are different from lengths of the plurality of second passages.

18. The refrigerator according to claim 17, wherein the plurality of first passages include a plurality of first long-side passages and a plurality of first short-side passage that are disposed at a first side of the heat exchange fin and that are alternately arranged in the longitudinal direction, a length of each first long-side passage being greater than a length of each first short-side passage in the longitudinal direction, and wherein the plurality of second passages include a plurality of second long-side passages and a plurality of second short-side passage that are disposed at a second side of the heat exchange fin opposite to the first side in the width direction and that are alternately arranged in the longitudinal direction, a length of each second long-side passage being greater than a length of each second short-side passage in the longitudinal direction.

19. A refrigerator comprising:

a main body defining a storage space;

a cryogenic compartment defining an insulation space configured to maintain a compartment temperature independent of a temperature in the storage space;

an evaporator located inside of the storage space and configured to cool the storage space; and a thermoelectric device assembly located at the cryogenic compartment and configured to cool the cryogenic compartment to the compartment temperature that is less than the temperature of the storage space, wherein the thermoelectric device assembly comprises:

a thermoelectric device comprising a heat absorption surface and a heat generation surface, a cold sink located in the cryogenic compartment and configured to contact the heat absorption surface of the thermoelectric device, and a heat sink that contacts the heat generation surface of the thermoelectric device and that is configured to be cooled by refrigerant supplied to the evaporator, wherein the heat sink comprises:

a sink body the defines an accommodation space configured to receive refrigerant therein, a cover plate that covers at least a portion of the accommodation space and that contacts the heat generation surface, and a heat exchange fin located inside of the accommodation space and configured to guide flow of refrigerant in the sink body, and wherein the heat sink further comprises a fin fixing part disposed in the accommodation space and configured to fix the heat exchange fin at a position that is spaced apart from an inner surface of the accommodation space.

20. A refrigerator comprising:

a main body defining a storage space;

a cryogenic compartment defining an insulation space configured to maintain a compartment temperature independent of a temperature in the storage space;

an evaporator located inside of the storage space and configured to cool the storage space; and a thermoelectric device assembly located at the cryogenic compartment and configured to cool the cryogenic compartment to the compartment temperature that is less than the temperature of the storage space, wherein the thermoelectric device assembly comprises:

a thermoelectric device comprising a heat absorption surface and a heat generation surface, a cold sink located in the cryogenic compartment and configured to contact the heat absorption surface of the thermoelectric device, and a heat sink that contacts the heat generation surface of the thermoelectric device and that is configured to be cooled by refrigerant supplied to the evaporator, wherein the heat sink comprises:

a sink body the defines an accommodation space configured to receive refrigerant therein, a cover plate that covers at least a portion of the accommodation space and that contacts the heat generation surface, and a heat exchange fin located inside of the accommodation space and configured to guide flow of refrigerant in the sink body, wherein the heat exchange fin comprises:

a plurality of contact parts that are in surface contact with the cover plate and that are configured to exchange heat with the cover plate, and a fin connection part that is bent from an end of each of the plurality of contact parts and that connects the plurality of contact parts to one another, and wherein the plurality of contact parts and the fin connection part are arranged in a width direction of the heat exchange fin.

* * * * *